US008176574B2

(12) United States Patent
Bryant et al.

(10) Patent No.: US 8,176,574 B2
(45) Date of Patent: May 15, 2012

(54) PROTECTIVE HELMET

(75) Inventors: Mark Bryant, Narraweena (AU); John Vozzo, Narraweena (AU)

(73) Assignee: Voz Corp Pty Ltd, Sydney (AU)

( * ) Notice: Subject to any disclaimer, the term of this patent is extended or adjusted under 35 U.S.C. 154(b) by 382 days.

(21) Appl. No.: 12/094,528

(22) PCT Filed: Nov. 23, 2006

(86) PCT No.: PCT/AU2006/001770

§ 371 (c)(1),
(2), (4) Date: May 21, 2008

(87) PCT Pub. No.: WO2007/059575

PCT Pub. Date: May 31, 2007

(65) Prior Publication Data

US 2008/0289085 A1 Nov. 27, 2008

(30) Foreign Application Priority Data

Nov. 23, 2005 (AU) ..... 2005906523

(51) Int. Cl.

| | |
|---|---|
| ***A42B 1/08*** | (2006.01) |
| ***A42B 1/06*** | (2006.01) |
| ***A42B 7/00*** | (2006.01) |
| ***A63B 71/10*** | (2006.01) |

(52) U.S. Cl. ..... 2/424; 2/410; 2/421; 2/425

(58) Field of Classification Search ..... 2/410, 6.1, 2/6.2, 6.3, 6.4, 6.5, 6.6, 6.7, 6.8, 7, 411, 412, 2/413, 414, 415, 416, 417, 418, 419, 420, 2/421, 422, 423, 424, 425; D29/102, 103, D29/104, 105, 106, 107, 108, 109, 110
See application file for complete search history.

(56) References Cited

U.S. PATENT DOCUMENTS 1,280,684 A * 10/1918 Domanski ..... 2/6.6
2,861,272 A * 11/1958 Stuart et al. ..... 2/6.6
3,239,843 A * 3/1966 Lobelle ..... 2/6.4
(Continued)

FOREIGN PATENT DOCUMENTS

CA 2096541 5/1992
(Continued)

OTHER PUBLICATIONS

Andy's EZwoodshop, "Rabbet and Dado Joint", <http://www.ezwoodshop.com/wood-joints-rabbet-dado-joint.html>, Date Accessed: Apr. 19, 2010.*

(Continued)

*Primary Examiner* — Khoa Huynh
*Assistant Examiner* — Jane Yoon
(74) *Attorney, Agent, or Firm* — Workman Nydegger

(57) ABSTRACT

Described herein are various protective helmets, including helmets designed for equestrian use. In one embodiment, an equestrian helmet (1) includes a front shell (2) and a rear shell (3). Shell (3) is moveable with respect to shell (1) to provide the helmet with two configurations. The first of these is an open configuration where the helmet is configured for receiving within the helmet or removing from the helmet a human head (4). The second configuration is a closed where shell (3) is releasably lockingly engaged to shell (2) for securely containing head (4) within helmet (1).

16 Claims, 35 Drawing Sheets

U.S. PATENT DOCUMENTS

| | | | | |
|---|---|---|---|---|
| 3,572,329 | A * | 3/1971 | De Woskin | 606/204.15 |
| 3,943,571 | A * | 3/1976 | Boatman | 2/421 |
| 4,291,418 | A * | 9/1981 | Zeisler | 2/410 |
| 4,581,776 | A * | 4/1986 | Kie | 2/425 |
| 4,587,676 | A * | 5/1986 | Estadella | 2/424 |
| 4,665,569 | A * | 5/1987 | Santini | 2/425 |
| 4,955,089 | A * | 9/1990 | Beale | 2/410 |
| 5,758,639 | A * | 6/1998 | Ikonen | 128/201.25 |
| 5,787,513 | A * | 8/1998 | Sharmat et al. | 2/411 |
| 6,138,283 | A * | 10/2000 | Kress | 2/411 |
| 6,226,803 | B1 * | 5/2001 | Tanaka | 2/424 |
| 6,249,918 | B1 * | 6/2001 | Lacroix | 2/424 |
| 6,301,720 | B1 * | 10/2001 | Bataille et al. | 2/422 |
| 6,418,564 | B1 * | 7/2002 | Sheridan | 2/425 |
| 6,553,569 | B2 * | 4/2003 | Bush | 2/9 |
| 6,644,308 | B2 * | 11/2003 | Kalhok et al. | 128/201.24 |
| 6,804,829 | B2 * | 10/2004 | Crye et al. | 2/6.6 |
| 7,096,513 | B1 * | 8/2006 | Kress | 2/410 |
| 7,841,026 | B2 * | 11/2010 | Makris et al. | 2/424 |
| 2002/0010958 | A1 * | 1/2002 | Schiebl et al. | 2/413 |
| 2004/0006804 | A1 * | 1/2004 | Bush | 2/9 |
| 2004/0025231 | A1 * | 2/2004 | Ide et al. | 2/425 |
| 2005/0114975 | A1 * | 6/2005 | Ide et al. | 2/15 |
| 2005/0278835 | A1 * | 12/2005 | Ide et al. | 2/424 |

FOREIGN PATENT DOCUMENTS

| | | | |
|---|---|---|---|
| CA | 2542544 | | 10/2006 |
| DE | 9315714 | U1 | 12/1993 |
| DE | 20214214 | U1 | 12/2002 |
| EP | 0074658 | A2 | 3/1983 |
| EP | 0290293 | B1 | 10/1991 |
| EP | 1103194 | A2 | 5/2001 |
| FR | 2546381 | A1 * | 11/1984 |
| JP | 03-014607 | | 1/1991 |
| WO | 9823177 | | 6/1998 |
| WO | 03026452 | A1 | 4/2003 |
| WO | 2004019717 | A2 | 3/2004 |
| WO | 2004019717 | A2 | 3/2004 |
| WO | 2005/082187 | A1 | 9/2005 |
| WO | 2006005184 | A1 | 1/2006 |
| WO | 2006045912 | A1 | 5/2006 |
| WO | 2006099928 | A1 | 9/2006 |
| WO | 2007055777 | A1 | 5/2007 |

OTHER PUBLICATIONS

Merriam-Webster OnLine, "rabbet", <http://www.merriam-webster.com/dictionary/rabbet>, Date Accessed: Jan. 16, 2010.*

European Search Report, Application No. 06817529.8-1256 / 1951077 PCT/AU2006001770, Applicant Voz Corp Pty Ltd., Mailed Apr. 21, 2011, 5 pages.

ROOF: Beyond the appearance Retrieved: Oct. 17, 2011 http://roof.fr/innovations/index.php?year=2003.

English Translation of Japanese Office Action in Japanese Patent Application No. 2008-541549, Sep. 20, 2011.

* cited by examiner

PROTECTIVE HELMET

FIELD OF THE INVENTION

The present invention relates to a protective helmet.

The invention has been primarily developed for use in equestrian activities such as horseracing, and will be described herein with particular reference to that application. However, it will be appreciated that the invention is not limited to such a field of use, and is generally applicable as a protective helmet for alternate purposes.

BACKGROUND TO THE INVENTION

Any discussion of the prior art throughout the specification should in no way be considered as an admission that such prior art is widely known or forms part of common general knowledge in the field.

Known protective helmets typically for equestrian activities consist of a protective shell that is secured to a user's head by way of a chinstrap. These helmets are designed to cover the most crucial regions of the head, but leave unprotected areas such as the chin, jaw and cheeks. Although helmets commonly used for other purposes offer considerable projection to these less crucial areas, they are generally unsuitable for equestrian activities. For any given sport it is usual for an independent authority to set helmet safely standards. Different standards applying to equestrian helmets—as compared for example with bicycle helmets—typically render other helmets unsuitable for equestrian use. Further, the weight and bulk of alternate protective helmets is often not tolerable for competitive equestrian activities.

For equestrian activities, a protective helmet typically requires particular deflection properties to at least in theory reduce the effect of an impact from a horse's hoof. The underlying rationale is that by deflecting an impacting hoof at an appropriate angle, a substantial component of the impact is directed away from the wearer's head. Deflection requirements are often written into equestrian helmet safety standards—for example the Australian and New Zealand AS/NZ 3838 standard.

Known chinstrap systems used in conventional helmets are by no means ideal. For example: the helmet is susceptible, during an impact, to being moved out of the intended alignment with the head. This misalignment is known to increase the risk of injury of the user—for example if the temple region is exposed. In addition, chinstraps axe known to break. This results in further adverse positioning—or indeed inadvertent compete removal of the helmet. These chinstrap deficiencies apply not only to equestrian helmets, but also to a multitude of other known protective helmets.

SUMMARY OF THE INVENTION

It is an object of the present invention to overcome or ameliorate at least one of the disadvantages of the prior art, or to provide a useful alternative.

In accordance with a first aspect of the invention, there is provided an equestrian helmet including:

- a front shell; and
- a rear shell moveable with, respect to the front shell to provide:
  - an open configuration for receiving within the helmet or removing from the helmet ahead; and
  - a closed configuration wherein the rear shell is releasably lockingly engaged to the front shell fox securely containing the head within the helmet.

Preferably the front shell includes a first edge complimentarily engageable with a second edge on the rear shell. More preferably the first and second edges include respective complimentary inter-engaging locating formations. Preferably these locating formations extend substantially along the length of the edges. In a preferred embodiment these locating formations are mutually locatingly engaged when the helmet is in the closed configuration to substantially transversely locate the front shell with respect to the rear shell. Preferably the locating formations are defined by the cross-sectional profiles of the first and second edges. Preferably one of the edges includes a beaded peripheral lip to define one of the complimentary locating formations and the other edge includes a recessed peripheral channel for receiving the lip to define the other complimentary locating formation. In one embodiment the second edge includes the peripheral lip. Preferably the first and second edges terminate substantially adjacent a stepped region of the helmet.

Preferably the helmet includes an upper portion and a lower portion connected by the stepped region. More preferably the upper and lower portions are each partially defined on both of the front and rear shells. Preferably the helmet includes a casing layer defining an outermost surface substantially covering the exterior of the helmet. Preferably the upper portion is bulbous such that it substantially resembles a known equestrian helmet.

Preferably the outer casing layer includes an outer surface that substantially provides a predetermined deflection angle. Preferably this deflection angle is between 30 and 60 degrees. In a preferred embodiment the angle is about 45 degrees.

Preferably the outer casing layer is formed from materials including any one or more of:

- kevlar;
- graphite;
- carbon
- fibreglass;
- resin; and
- plastics.

In some embodiments the outer casing layer is hand-made. In other embodiments it is Injection moulded. Various manufacturing techniques are used among further embodiments.

Preferably, front shell includes a first fitting zone for engagement with the forehead region of the head and a second fitting zone for engagement with a chin region of the head. Preferably engagement with the chin region includes cupping the chin to substantially prevent movement about at least two axes. Preferably the first fitting zone is located on the upper portion and the second fitting zone is located on the lower portion. In some embodiments the second fitting zone is movable with respect to the first fitting zone. In one embodiment the second fitting zone is provided on a fitting member that is slidably movable along an adjustment path. Preferably the fitting member is releasably lockingly engagable at a plurality of locations on the adjustment path thereby to provide a respective plurality of selectable positions for the second fitting zone and in doing so provide a customizable fit.

Preferably the rear shell includes a third fitting zone for engagement with a posterior region of the head when the helmet is in the closed configuration to provide a three zone fitting system for securely containing the head within the helmet. More preferably the second fitting zone conforms to the jaw region to axially secure the helmet with respect to the head. Preferably a fourth fitting zone is inherently defined on each side of the helmet for engagement with regions at each side of the head to transversely secure the helmet with respect to the head.

Preferably the front and rear shells are lockingly engagable by a multiple point locking system. Preferably this is a three point locking system. More preferably the locking system includes an upper dorsal connection and two lower side connections. Preferably the upper dorsal includes a hinge such that the rear shell is hingedly connected to the front shell. More preferably the rear shell rotates about this connection to move the helmet from the closed configuration to the open configuration.

Preferably each side connection includes an adjustable connector mechanism for designating a selectable proximity between adjacent connector regions of the front and rear shells. Preferably the mechanism includes an elongate member selectively releasably lockingly engageable with a complimentary fitment. Preferably the front shell includes the member and the rear shell includes the fitment. In a preferred embedment the member extends progressively through the fitment upon the engagement to define a tail portion. Preferably the member is rotatable with respect to the front shell such that it remains within the fitment upon hinged rotation of the shells.

Preferably a tunnel is provided foe receiving and concealing the tail portion. In some embodiments the tunnel is defined by an inner shell mounted to and formed independently of the rear shell.

Preferably the fitments are moveable from a locked configuration in which the allowed passage of the member is unidirectional and an unlocked configuration, in which the allowed passage of the member is bi-directional. Preferably both fitments must be in the unlocked configuration for the helmet to move from the closed to open configuration. In one embodiment the fitments are binding latches and the members are complimentary binding straps.

Preferably the front shell includes an aperture for facilitating vision by the received head to the exterior of the helmet. Preferably this aperture extends approximately 240 degrees about a central axis of the helmet. More preferably this aperture is defined by a beaded periphery.

Preferably the helmet includes an opening for receiving a user's head when in the open configuration. More preferably relative movement of the front and rear shells adjusts the size of this opening. Preferably this opening is defined by a third edge of the front shell and a fourth edge of the rear shell. Preferably these edges are beaded.

Preferably the rear shell includes a lower support edge for engagement with a muscular region of a back defined on the body providing the head.

Preferably the front shell is hingedly connected to the rear shell. More preferably this hinged connection is provided by a hinge assembly provided at a dorsal location on the helmet. More preferably, when the helmet is in the closed configuration the hinge assembly is substantially contoured with the surface of the helmet. In a preferred embodiment the hinge assembly includes pin-receiving formations respectively extending from the front and rear shells. Preferably these formations are integrally formed from their respective shells. Preferably the pin-receiving formations include respective coaxially positionable apertures for receiving a common hinge pin. Preferably each pin-receiving formation extends in substantially constant contour with respect to an adjacent area of the respective shell.

Preferably each shell includes an outer casing layer and an inner lining layer. Preferably the lining layer includes a front lining layer on the from shell and a rear lining on the rear shell. Also preferably the inner lining layer includes a resilient padding material.

Preferably each lining layer includes an outer sub-layer and an inner sub-layer. Preferably the outer sub-layer is formed of a resilient material. More preferably the outer sub-layer mounts the lining layer to the casing layer.

Preferably the inner sub-layer is selectively detachable from the outer sub-layer. Preferably the lining layer is foam injectable. In some embodiments a cavity for receiving foam to facilitate foam injection is defined intermediate the inner sub-layer and outer sub-layer. Preferably one or more resilient spacers extend between the sub-layers such that the helmet is centrally locatable on a head prior to foam injection. Typically the outer casing layer and lining layer include respective apertures such that foam is injectable through these layers and into the cavity.

Preferably a visor assembly is mountable to the helmet. More preferably this visor assembly is mountable to the front shell. Typically the visor assembly is removably mounted to the front shell.

In a preferred embodiment the visor includes sensing equipment. In some embodiments this equipment includes a camera. More preferably the equipment also includes a transmitter for transmitting a signal provided by the camera. In some embodiments the equipment includes position identification apparatus. Preferably this apparatus makes use of global positioning technology such as GPS.

In accordance with a second aspect of the invention, there is provided a protective helmet including:

- a front shell; and
- a rear shell moveable with respect to the front shell to provide the helmet with:
  - an open configuration for receiving within the helmet or removing from the helmet a head; and
  - a closed configuration wherein the rear shell is releasably lockingly engaged to the front shell for securely containing the head within the helmet.

Preferably the front shell includes a first edge complimentarily engageable with a second edge on the rear shell. More preferably the first and second edges include respective complimentary interengaging locating formations. Preferably these locating formations extend substantially along the length of the edges. In a preferred embodiment these locating formations are mutually locatingly engaged when the helmet is in the closed configuration to substantially transversely locate the front shell with respect to the rear shell. Preferably the locating formations are defined by the cross-sectional profiles of the first and second edges. Preferably one of the edges includes a beaded peripheral lip to define one of the complimentary locating formations and the other edge includes a recessed peripheral channel for receiving the lip to define the other complimentary locating formation. In one embodiment the second edge includes the peripheral lip. Preferably the first and second edges terminate substantially adjacent a stepped region of the helmet.

Preferably the helmet includes an upper portion and a lower portion connected by the stepped region. More preferably the upper and lower portions are each partially defined on both of the front and rear shells. Preferably the helmet includes a casing layer defining an outermost surface substantially covering the exterior of the helmet. Preferably the upper portion is bulbous such that it substantially resembles a known equestrian helmet.

Preferably the outer casing layer includes an outer surface that substantially provides a predetermined deflection angle. Preferably this deflection angle is between 30 and 60 degrees. In a preferred embodiment the angle is about 45 degrees.

Preferably the outer casing layer is formed from materials including any one or more of:

kevlar;
graphite;
carbon
fibreglass;
resin; and
plastics.

In some embodiments the outer casing layer is hand-made. In other embodiments it is injection moulded. Various manufacturing techniques are used among further embodiments.

Preferably, front shell includes a first fitting zone for engagement with the forehead region of the head and a second fitting zone for engagement with a chin region of the head. Preferably the first fitting zone is located on the upper portion and the second fitting zone is located on the lower portion.

Preferably the rear shell includes a third fitting zone for engagement with a posterior region of the head when the helmet is in the closed configuration to provide a three zone fitting system for securely containing the head within the helmet. More preferably the second fitting zone conforms to the jaw region to axially secure the helmet with respect to the head. Preferably a fourth fitting zone is inherently defined on each side of the helmet for engagement with regions at each side of the head to transversely secure the helmet with respect to the head.

Preferably the front and rear shells are lockingly engagable by a multiple point locking system. Preferably this is a three point locking system. More preferably the locking system includes an upper dorsal connection and two lower side connections. Preferably the upper dorsal includes a hinge such that the rear shell is hingedly connected to the front shell. More preferably the rear shell rotates, about this connection to move the helmet from the closed configuration to the open configuration.

Preferably each side connection includes an adjustable connector mechanism fox designating a selectable proximity between adjacent connector regions of the front and rear shells. Preferably the mechanism includes an elongate member selectively releasably lockingly engageable with a complimentary fitment. Preferably the front shell includes the member and the rear shell includes the fitment. In a preferred embedment the member extends progressively through the fitment upon the engagement to define a tail portion. Preferably the member is rotatable with respect to the front shell such that it remains within the fitment upon hinged rotation of the shells.

Preferably a tunnel is provided for receiving and concealing the tail portion. In some embodiments the tunnel is defined by an inner shell mounted to and formed independently of the rear shell.

Preferably the fitments are moveable from a locked configuration in which the allowed passage of the member is unidirectional and an unlocked configuration in which the allowed passage of the member is bi-directional. Preferably both, fitments must be in the unlocked configuration for the helmet to move from the closed to open configuration. In one embodiment the fitments, are binding latches and the members are complimentary binding straps.

Preferably the front shell includes an aperture for facilitating vision by the received head to the exterior of the helmet. Preferably this aperture extends approximately 240 degrees about a central axis of the helmet. More preferably this aperture is defined by a beaded periphery.

Preferably the helmet includes an opening for receiving a user's head when in the open configuration. More preferably relative movement of the front and rear shells adjusts the size of this opening. Preferably this opening is defined by a third edge of the front shell and a fourth edge of the rear shell. Preferably these edges are beaded.

Preferably the rear shell includes a lower support edge for engagement with a muscular region of a back defined on the body providing the head.

Preferably the front shell is hingedly connected to the rear shell. More preferably this hinged connection is provided by a hinge assembly provided at a dorsal location on the helmet. More preferably, when the helmet is in the closed configuration the hinge assembly is substantially contoured with the surface of the helmet. In a preferred embodiment the hinge assembly includes pin-receiving formations respectively extending from the front and rear shells. Preferably these formations are integrally formed from their respective shells. Preferably the pin-receiving formations include respective coaxially positionable apertures for receiving a common hinge pin. Preferably each pin-receiving formation extends in substantially constant contour with respect to an adjacent area of the respective shell.

Preferably each shell includes an outer casing layer and an inner lining layer. Preferably the lining layer includes a front lining layer on the front shell and a rear lining on the rear shell. Also preferably the inner lining layer includes a resilient padding material.

Preferably each lining layer includes an outer sub-layer and an inner sub-layer. Preferably the outer sub-layer is formed of a resilient material. More preferably the outer sub-layer mounts the lining layer to the casing layer.

Preferably the inner sub-layer is selectively detachable from the outer sub-layer. Preferably the lining layer is foam injectable. In some embodiments a cavity for receiving foam to facilitate foam injection is defined intermediate the inner sub-layer outer sub-layer. Preferably one or more resilient spacers extend between the sub-layers such that the helmet is centrally locatable on a head prior to foam injection. Typically the outer casing layer and lining layer include respective apertures such that foam is injectable through these layers and into the cavity.

Preferably a visor assembly is mountable to the helmet. More preferably this visor assembly is mountable to the front shell. Typically the visor assembly is removably mounted to the front shell.

In a preferred embodiment the visor includes sensing equipment. In some embodiments this equipment includes a camera. More preferably the equipment also includes a transmitter for transmitting a signal provided by the camera. In some embodiments the equipment includes position identification apparatus. Preferably this apparatus makes use of global positioning technology such as GPS.

In accordance with a third aspect of the invention, there is provided a helmet for a jockey, the helmet including:

a front shell; and
a rear shell moveable with respect to the front shell to provide the helmet with:
an open configuration for receiving within the helmet or removing from the helmet a head; and
a closed configuration wherein the rear shell is releasably lockingly engaged to the front shell for securely containing the head within the helmet.

Preferably the front shell includes a first edge complimentarily engageable with a second edge on the rear shell. More preferably the first and second edges include respective complimentary interengaging locating formations. Preferably these locating formations extend substantially along the length of the edges. In a preferred embodiment these locating formations are mutually locatingly engaged when the helmet is in the closed configuration to substantially transversely locate the front shell with respect to the rear shell. Preferably the locating formations are defined by the cross-sectional profiles of the first and second edges. Preferably one of the edges includes a beaded peripheral lip to define one of the complimentary locating formations and the other edge includes a recessed peripheral channel for receiving the lip to define the other complimentary locating formation. In one embodiment the second edge includes the peripheral lip. Preferably the first and second edges terminate substantially adjacent a stepped region of the helmet.

Preferably the helmet includes an upper portion and a lower portion connected by the stepped region. More preferably the upper and lower portions are each partially defined on both of the front and rear shells. Preferably the helmet includes a casing layer defining an outermost surface substantially covering the exterior of the helmet. Preferably the upper portion is bulbous such that it substantially resembles a known equestrian helmet.

Preferably the outer casing layer includes an outer surface that substantially provides a predetermined deflection angle. Preferably this deflection angle is between 30 and 60 degrees. In a preferred embodiment the angle is about 45 degrees.

Preferably the outer casing layer is formed from materials including any one or more of:

kevlar;
graphite;
carbon,
fibreglass;
resin; and
plastics.

In some embodiments the outer casing layer is hand-made. In other embodiments it is injection moulded. Various manufacturing techniques are used among further embodiments.

Preferably, front shell includes a first fitting zone for engagement with the forehead region of the head and a second fitting zone for engagement with a chin region of the head. Preferably the first fitting zone is located on the upper portion and the second fitting zone is located on the lower portion.

Preferably the rear shell includes a third fitting zone for engagement with a posterior region of the head when the helmet is in the closed configuration to provide a three zone fitting system for securely containing the head within the helmet. More preferably the second fitting zone conforms to the jaw region to axially secure the helmet with respect to the head. Preferably a fourth fitting zone is inherently defined on each side of the helmet for engagement with regions at each side of the head to transversely secure the helmet with respect to the head.

Preferably the front and rear shells are lockingly engagable by a multiple point locking system. Preferably this is a three point locking system. More preferably the locking system includes an upper dorsal connection and two lower side connections. Preferably the upper dorsal includes a hinge such that the rear shell is hingedly connected to the front shell. More preferably the rear shell rotates about this connection to move the helmet from the closed configuration to the open configuration.

Preferably each side connection includes an adjustable connector mechanism for designating a selectable proximity between adjacent connector regions of the front and rear shells. Preferably the mechanism includes an elongate member selectively releasably lockingly engageable with a complimentary fitment. Preferably the front shell includes the member and the rear shell includes the fitment. In a preferred embedment the member extends progressively through the fitment upon the engagement to define a tail portion. Preferably the member is rotatable with respect to the front shell such that it remains within the fitment upon hinged rotation of the shells.

Preferably a tunnel is provided for receiving and concealing the tail portion, in some embodiments the tunnel is defined by an inner shell mounted to and formed independently of the rear shell.

Preferably the fitments are moveable from a locked configuration in which the allowed passage of the member is unidirectional and an unlocked configuration in which the allowed passage of the member is bi-directional. Preferably both fitments must be in the unlocked configuration for the helmet to move from the closed to open configuration.

In one embodiment the fitments are binding latches and the members are complimentary binding straps.

Preferably the front shell includes an aperture for facilitating vision by the received head to the exterior of the helmet. Preferably this aperture extends approximately 240 degrees about a central axis of the helmet. More preferably this aperture is defined by a beaded periphery.

Preferably the helmet includes an opening for receiving a user's head when in the open configuration. More preferably relative movement of the front and rear shells adjusts the size of this opening. Preferably this opening is defined by a third edge of the front shell and a fourth edge of the rear shell. Preferably these edges are beaded.

Preferably the rear shell includes a lower support edge for engagement with a muscular region of a back defined on the body providing the head.

Preferably the front shell is hingedly connected to the rear shell. More preferably this hinged connection is provided by a hinge assembly provided at a dorsal location on the helmet. More preferably, when the helmet is in the closed configuration the hinge assembly is substantially contoured with the surface of the helmet. In a preferred embodiment the hinge assembly includes pin-receiving formations respectively extending from the front and rear shells. Preferably these formations are integrally formed from their respective shells. Preferably the pin-receiving formations include respective coaxially positionable apertures for receiving a common hinge pin. Preferably each pin-receiving formation extends in substantially constant contour with respect to an adjacent area of the respective shell.

Preferably each shell includes an outer casing layer and an inner lilting layer. Preferably the lining layer includes a front lining layer on the front shell and a rear lining on the rear shell. Also preferably the inner lining layer includes a resilient padding material.

Preferably each lining layer includes an outer sub-layer and an inner sub-layer. Preferably the outer sub-layer is formed of a resilient material. More preferably the outer sub-layer mounts the lining layer to the casing layer.

Preferably the inner sub-layer is selectively detachable from the outer sub-layer. Preferably the lining layer is foam injectable. In some embodiments a cavity for receiving foam to facilitate foam injection is defined intermediate the inner sub-layer outer sub-layer. Preferably one or more resilient spacers extend between the sub-layers such that the helmet is centrally locatable on a head prior to foam injection. Typically the outer casing layer and lining layer include respective apertures such that foam is injectable through these layers and into the cavity.

Preferably a visor assembly is mountable to the helmet. More preferably this visor assembly is mountable to the front shell. Typically the visor assembly is removably mounted to the front shell.

In a preferred embodiment the visor includes sensing equipment. In some embodiments this equipment includes a camera. More preferably the equipment also includes a transmitter for transmitting a signal provided by the camera. In some embodiments the equipment includes position identification apparatus. Preferably this apparatus makes use of global positioning technology such as GPS.

In accordance with a fourth aspect of the invention, there is provided a method for protecting a head including the steps of:

providing a front protective shell; and providing a rear protective shell moveable with respect to the front to define a helmet and provide:

an open configuration for receiving within the helmet or removing from the helmet a head; and a closed configuration wherein the rear shell is releasably lockingly engaged to the front shell for securely containing the head within the helmet.

According to a fifth aspect of the invention, there is provided a protective helmet including:

a front shell; and a rear shell releasably lockingly engageable with the front shell to define the helmet.

According to a sixth aspect of the invention, there is provided a system for monitoring the path of a jockey, the system including:

a locating device mounted to the jockey;

an interface for receiving a signal from the locating device; and a processor responsive to the signal for providing a presentation of the path of the jockey.

Preferably the locating device is mounted to a helmet. More preferably the helmet is a helmet in accordance with any one of the preceding aspects of the invention.

In some embodiments the locating device is a camera such that representation is visual. Preferably this camera provides a camera signal indicative of sequential image frames. More preferably the locating device further includes a transmitter for receiving the camera signal and providing this signal to a remote host. In some embodiments the remote host is the interface. In other embodiments the remote host is in communication with the interface. In some cases the remote host includes a plurality of geographically spaced hosts.

In some embodiments the locating device provides a signal indicative of positional information. Typically this involves the use of GPS triangulation. In some such embodiments the processor provides a representation indicative of the approximate of the path followed by the horse and jockey.

According to a further aspect of the invention there is provided a method for monitoring the path of a jockey, the method including the steps of:

mounting a locating device to the jockey;

receiving a signal from the locating device; and being responsive to the signal for providing a presentation of the path of jockey.

BRIEF DESCRIPTION OF THE DRAWINGS

A preferred embodiment of the invention will now be described, by way of example only, with reference to the accompanying drawings in which.

DETAILED DESCRIPTION

Figure 1:
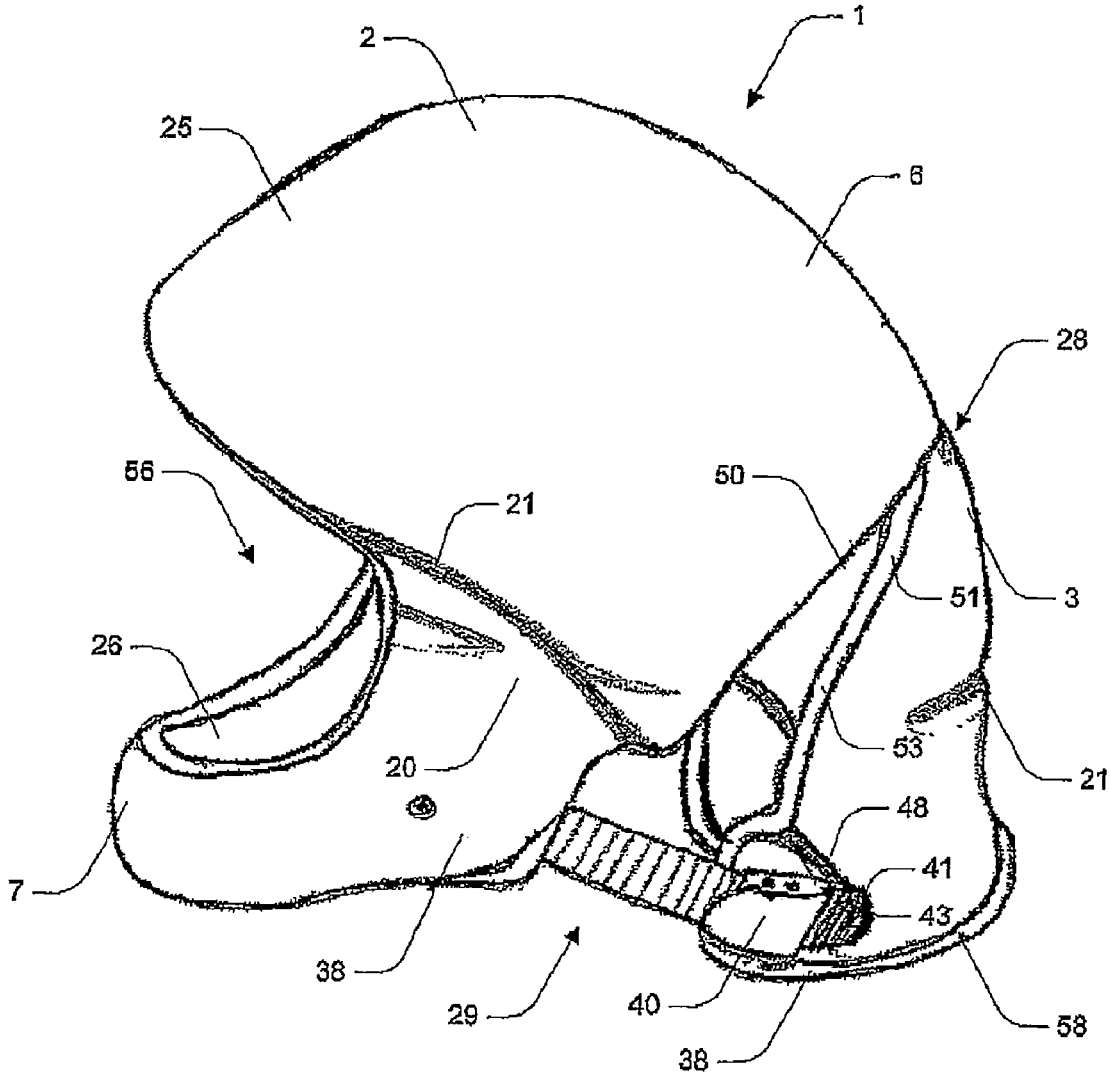
FIG. 1 is a side view of a protective helmet in accordance with an embodiment of the present invention shown in an open configuration.

Referring to the drawings, it will be appreciated that, in the different figures, corresponding features have been denoted by corresponding reference numerals.

Figure 2:
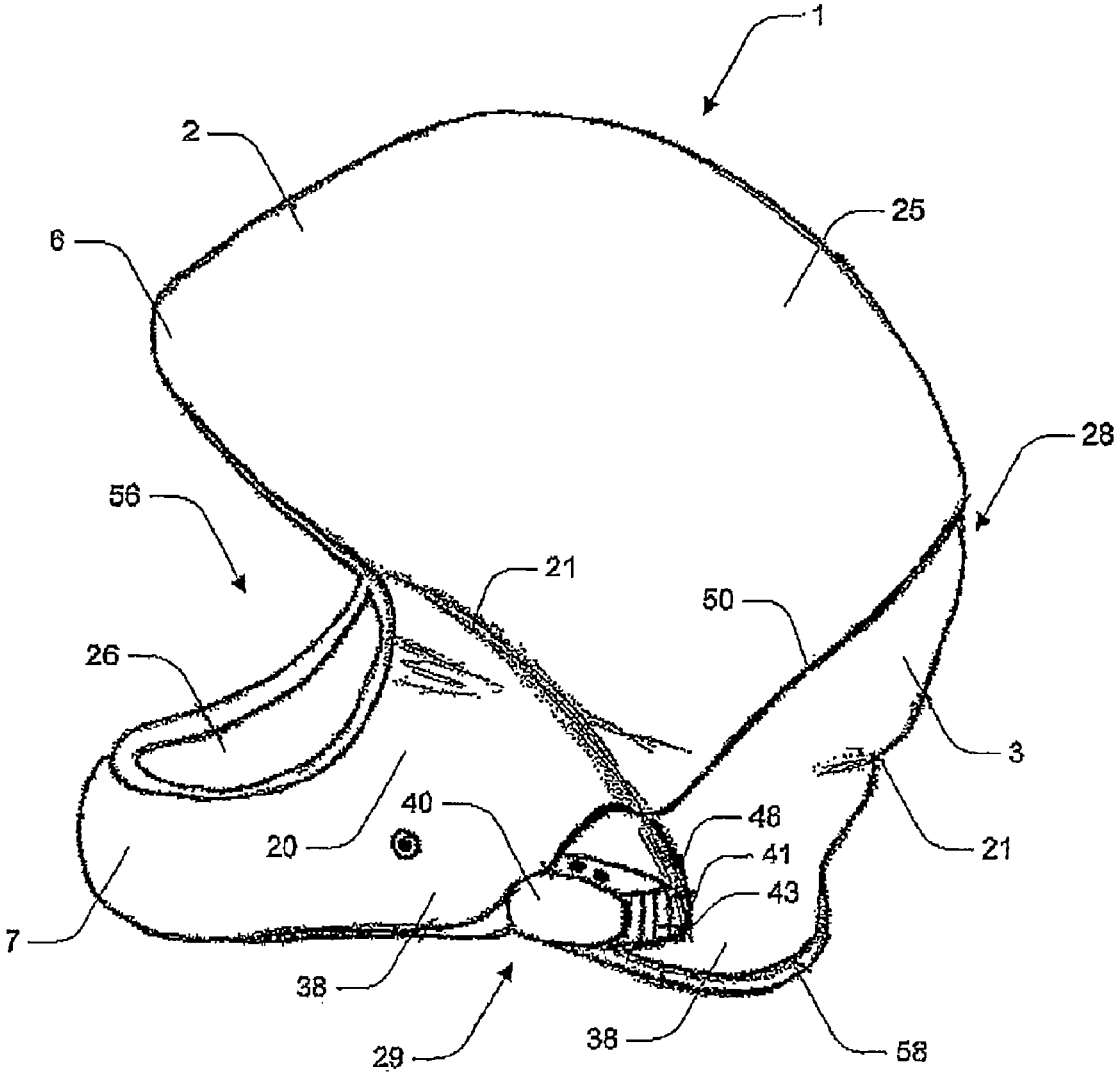
FIG. 2 is a view similar to FIG. 1, however showing the helmet in a closed configuration.
Figure 3:
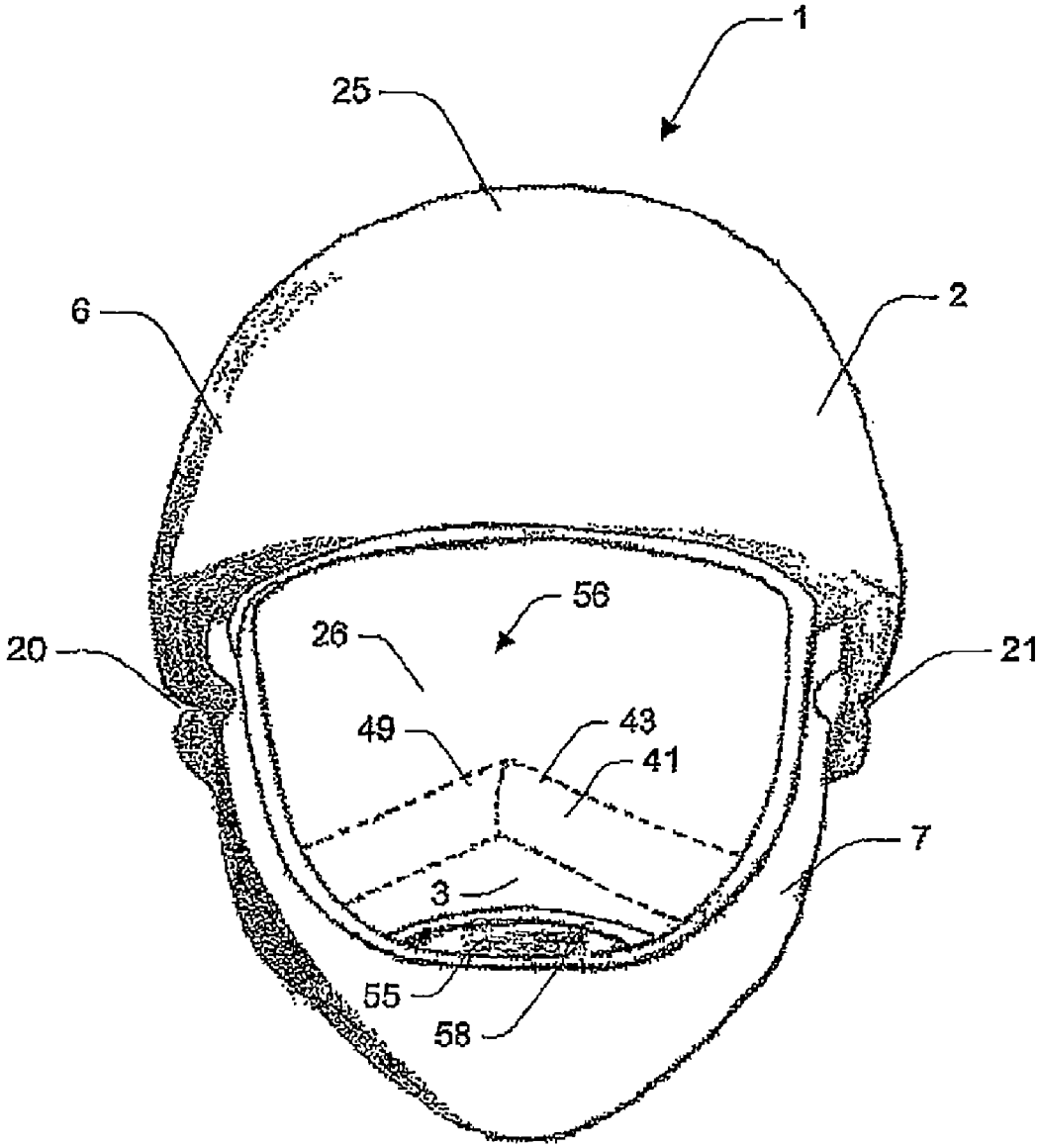
FIG. 3 is a front view of the helmet of FIG. 1, shown in the closed configuration.
Figure 4:
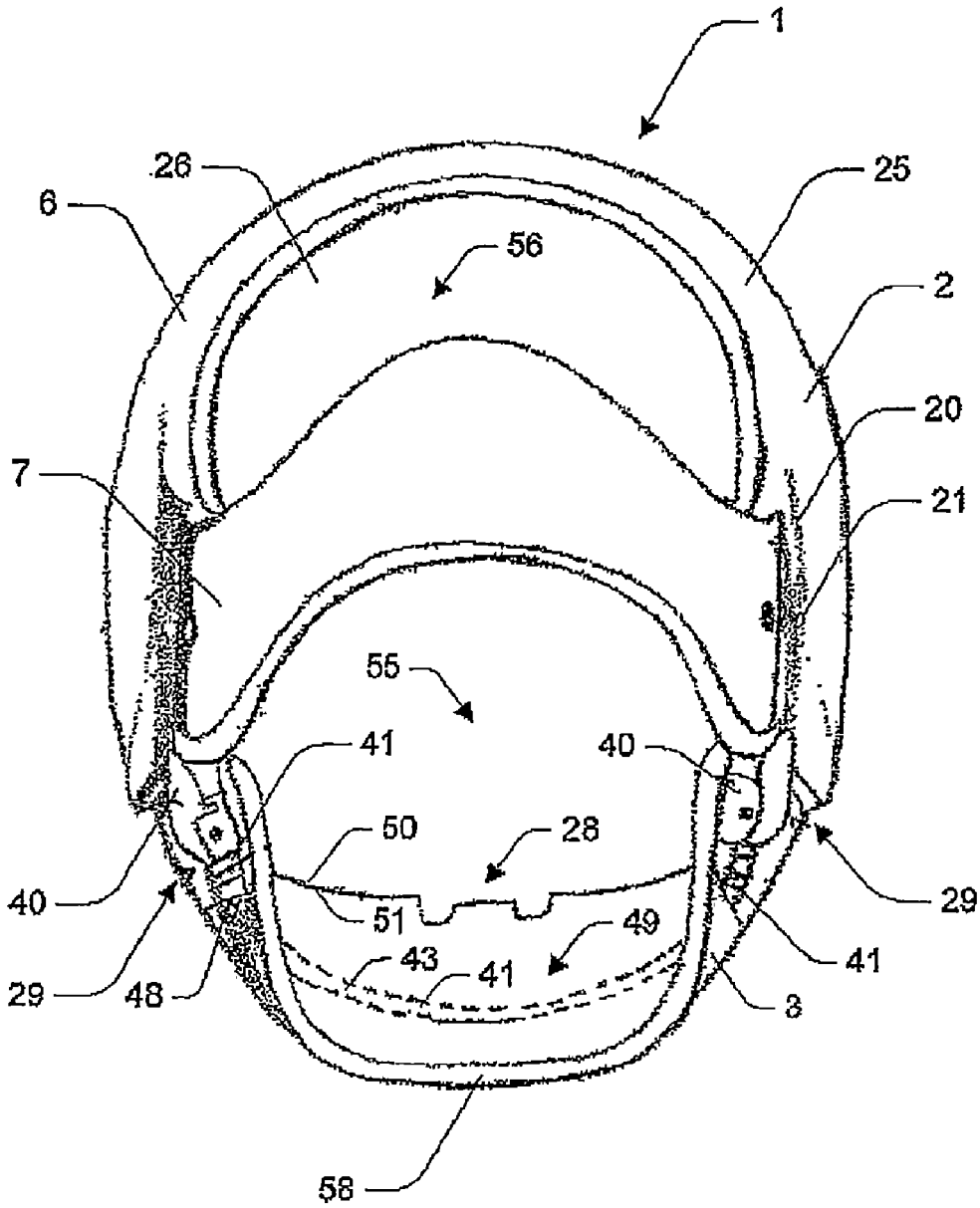
FIG. 4 is a lower front view of me helmet of FIG. 1, shown in the closed configuration.
Figure 5:
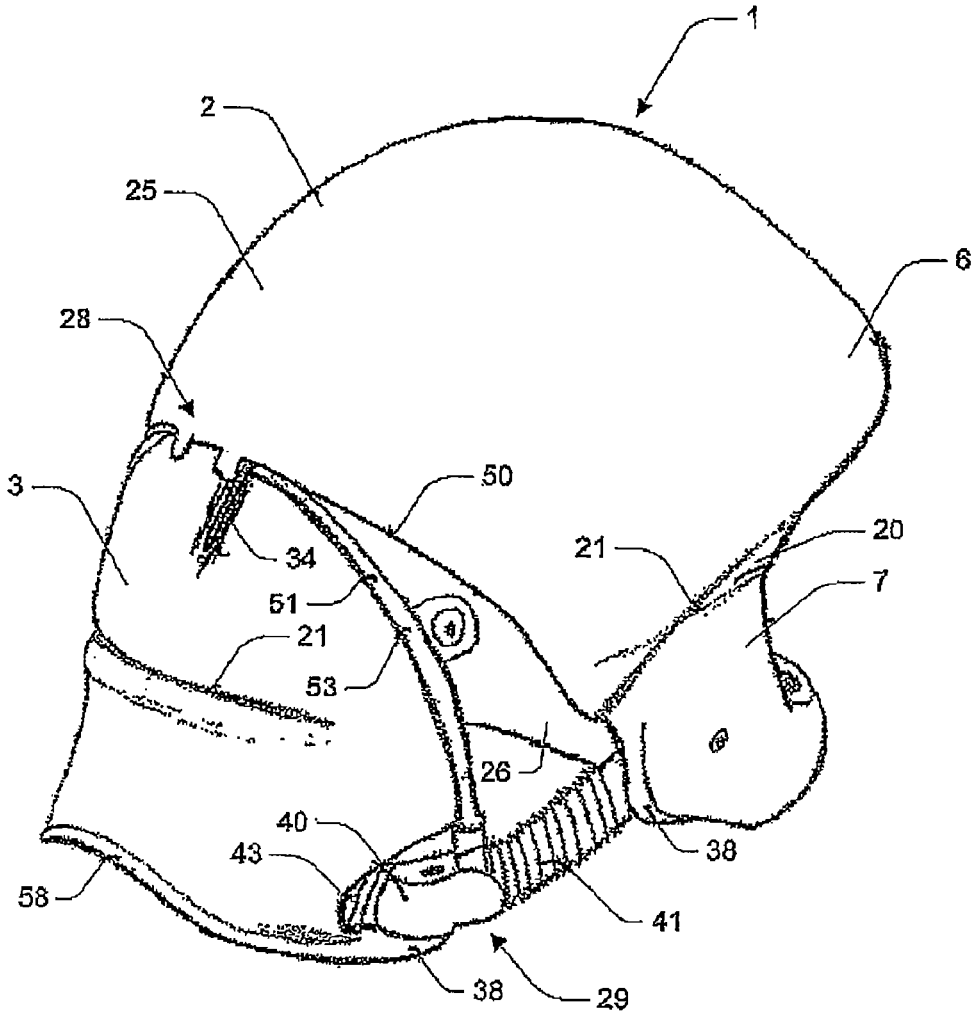
FIG. 5 is a rear/side view of the helmet of FIG. 1, shown in the open configuration.

FIG. 1 illustrates an equestrian helmet 1. Helmet 1 includes a front shell 2 and a rear shell 3. Shell 3 is moveable with respect to shell 1 to provide the helmet with two configurations. The first of these is an open configuration shown in FIG. 1, in the open configuration the helmet is configured for receiving within the helmet or removing from the helmet a human head 4. The second configuration is a closed configuration shown in FIG. 2. In this closed configuration shell 3 is releasably lockingly engaged to shell 2 for securely containing head 4 within helmet 1.

Although the present disclosure is particularly concerned with equestrian applications of the invention, it will be appreciated that these are not to be regarded as limiting in any way. In other embodiments the helmet is used for alternate activities, such as other sports. In some embodiments the helmet is adapted for specific military use. Those skilled in the relevant arts will recognise how helmet 1 is modified or adapted for alternate applications, and moreover which of the embodiments described herein are most suited to alternate applications.

For the purpose of this disclosure, head 4 being "securely contained" within helmet 1 denotes that head 4 is not removable from helmet 1. Preferably, it also denotes a level of maintained alignment between head 4 and helmet 1. This predefined alignment is maintained such that the helmet is substantially not movable with respect to the head. This includes axial rotation, transverse movement, and indeed shifting about substantially any axis. To remove head 4 from helmet 1, it is first necessary to move the helmet out of the closed configuration.

Other than shells 2 and 3, there are two general visually distinguishable portions of helmet 1. These are an upper portion 6 and a lower portion 7. These are not by any means discrete and separable—the distinction is generally notional. That is, the portions are identified primarily for descriptive purposes. Portions 6 and 7 each include portions of shells, 2 and 3. A stepped region 20 connects upper portion 6 and a lower portion 7. A groove 21 is provided on and generally identifies the location of region 20 to facilitate the retention of a strap for securing goggles or other eyewear. In some embodiments, such as the embodiment shown in FIGS. 21 to 23, there is no stepped region 20 and as such there is a smooth transition between portions 6 and 7.

Figure 6:
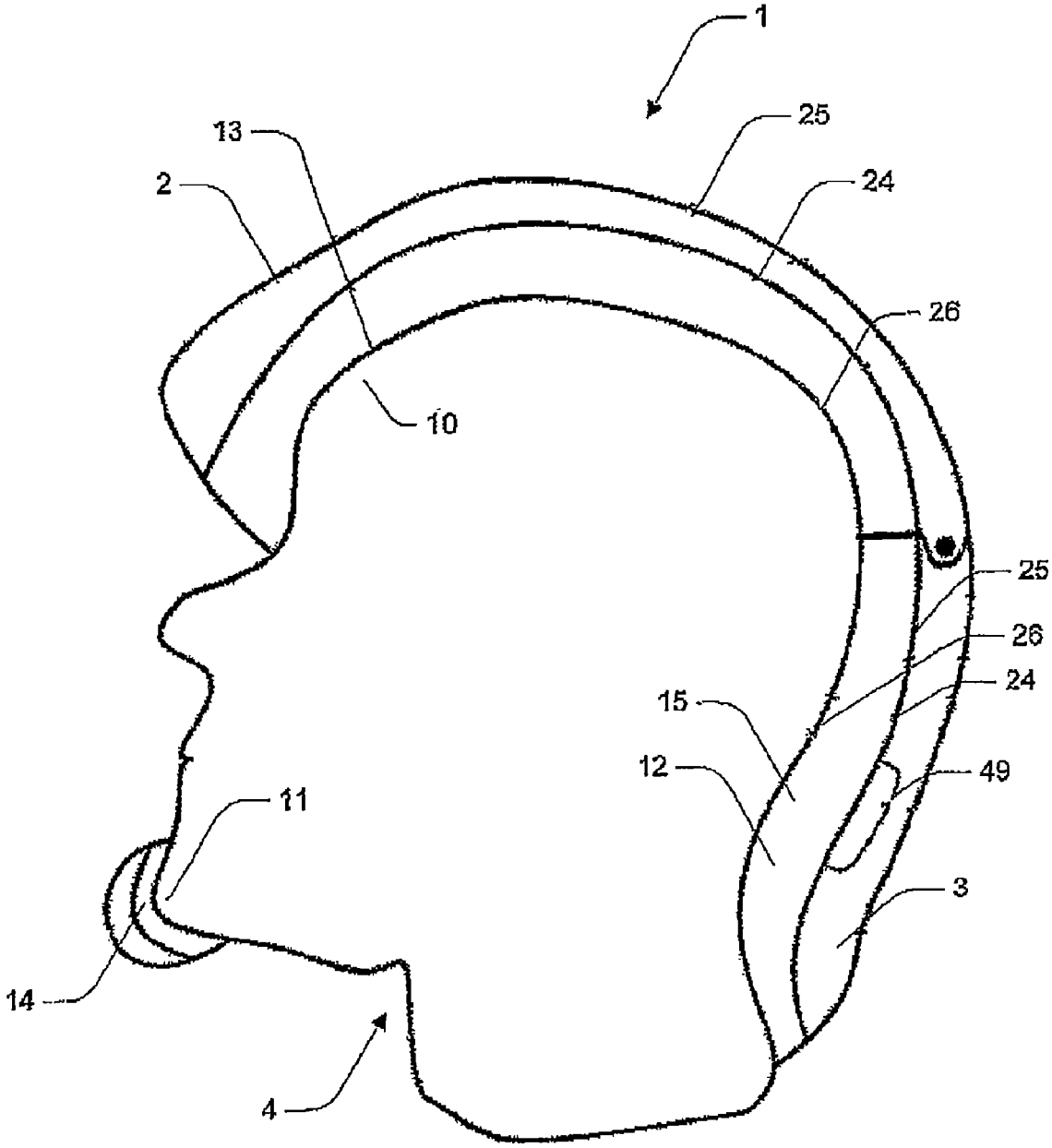
FIG. 6 is a schematic sectional view of the helmet of FIG. 1, shown in the closed configuration on a head.

Helmet 2 is fitted to head 4 using a three-point fitting system. This involves abutting engagement between helmet 1 and three regions of head 4. Presently, these are the forehead region 10, chin region 11, and a posterior region 12. This three-point fitting is best shown in FIG. 6. This figure is provided for simple schematic illustration only, and is not to scale. Many detailed features of helmet 1 are not shown.

Shell 2 includes a first fitting zone 13 for engagement with region 10. This zone 13 is found on portion 6. Shell 2 also includes a second fitting zone 14 for engagement with region 11. Fitting zone 14 is located on portion 7. Zone 14 conforms to the jaw region of head 4 to axially secure the helmet with respect to an axis generally defined by the neck of head 4. Shell 3 includes a third fitting zone 15 for engagement with region 12 when helmet 1 is in the closed configuration.

In the present embodiment, the fitting zones are provided by a resilient material, presently in the form of a foam 24 which compresses between a casing layer 25 and an inner lining 26. Appropriate foams or alternate resilient materials will be recognised by those skilled in the art. For example, some embodiments make use of materials conventionally used in safety helmets—such as expanded polystyrene (EPS).

In the present embodiment foam 24 compresses to substantially conform to its adjacent region 10 to 12 in a three-dimensional manner. It will be recognised that concurrent engagement with these three zones provides the secure engagement of helmet 1 to head 4.

In some embodiments foam 24 is first injected following insertion of head 4 to provide a customised fit. Using such a customised fit system inherently provides further fitting zones. Indeed, generally the entire inner surface of lining 26 is to some degree a fitting zone. This foam injection is carried out once only for a given helmet, and provides that helmet with a customised fit for the specific head 4 used. Foam injection is discussed in greater detail further below.

In some embodiments where customised a foam injection technique is not used, specific attention is paid to foam adjacent regions 10 to 12 such that adequate fitting zones are provided. For example, in some embodiments removable padding portions are provided for insertion inside the helmet at the fitting zones; these padding portions being provided in a plurality of sizes to allow a relatively customizable fit. In some embodiments these removable padding portions are mountable to an interior surface of the helmet using the likes of Velcro or an adhesive. In some embodiments the removable padded portions are formed of a more readily compressible material than the portion of the helmet to which they are to be mounted, as is common in some bicycle helmets. In some cases additional fitting zones are defined. For example, specific zones for engagement with the opposite sides of head 4.

It will be appreciated that, in embodiments that do not make use of a customised foam injection technique, alternate techniques are implemented to provide a degree of flexibility to the fitting zones and in doing so reduce the extent of difficulties in appropriately locating the three fitting zones to provide a suitable fit on a particular person's head. For example, some embodiments provide relatively resilient fitting zones that are able to compress for conforming to various head sizes, and some embodiments allow incremental movement of at least one of the fitting zones.

Figure 24:
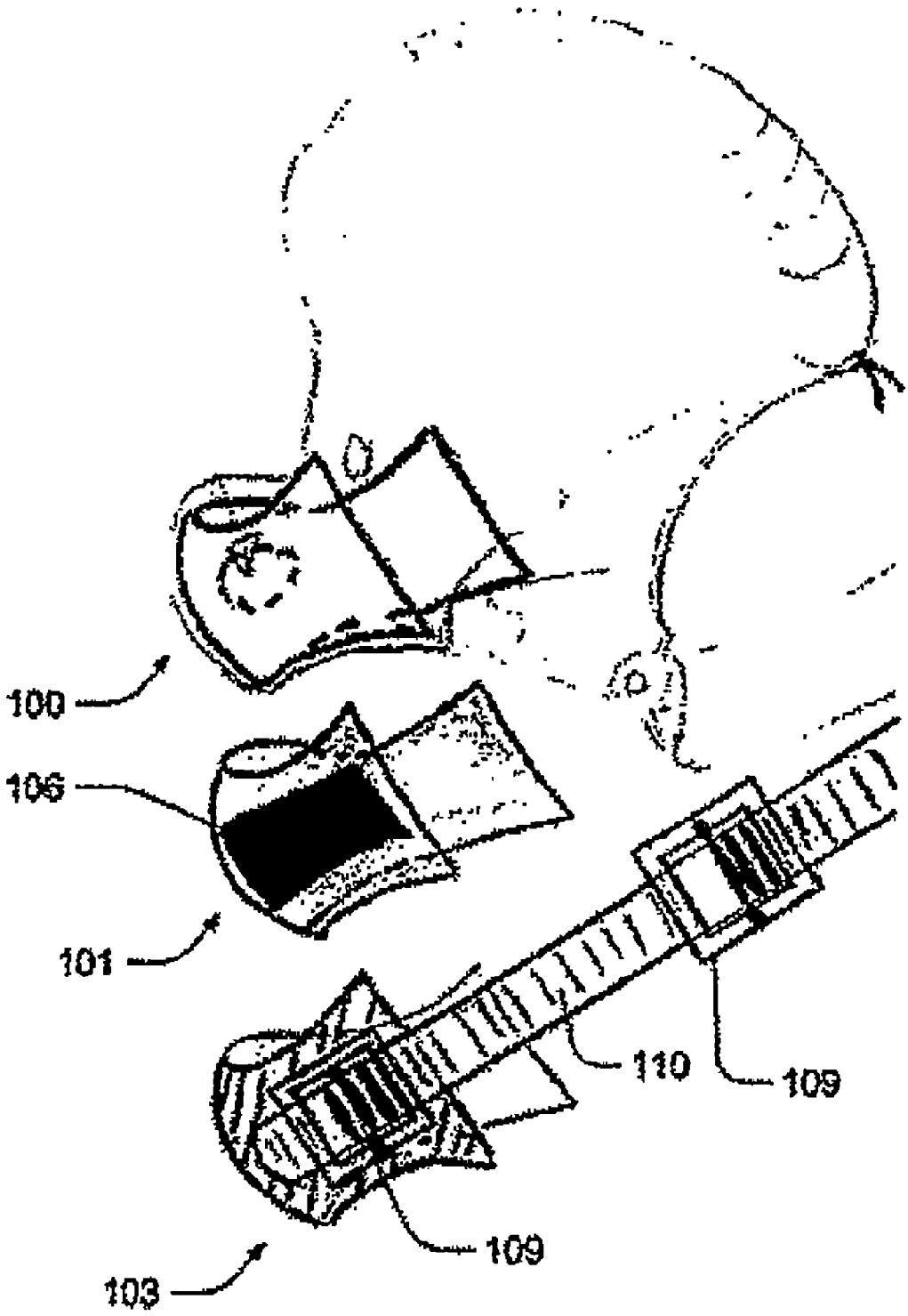
FIG. 24 illustrates an embodiment making use of a moulded chin, cup, along with some alternate chin cups.
Figure 25:
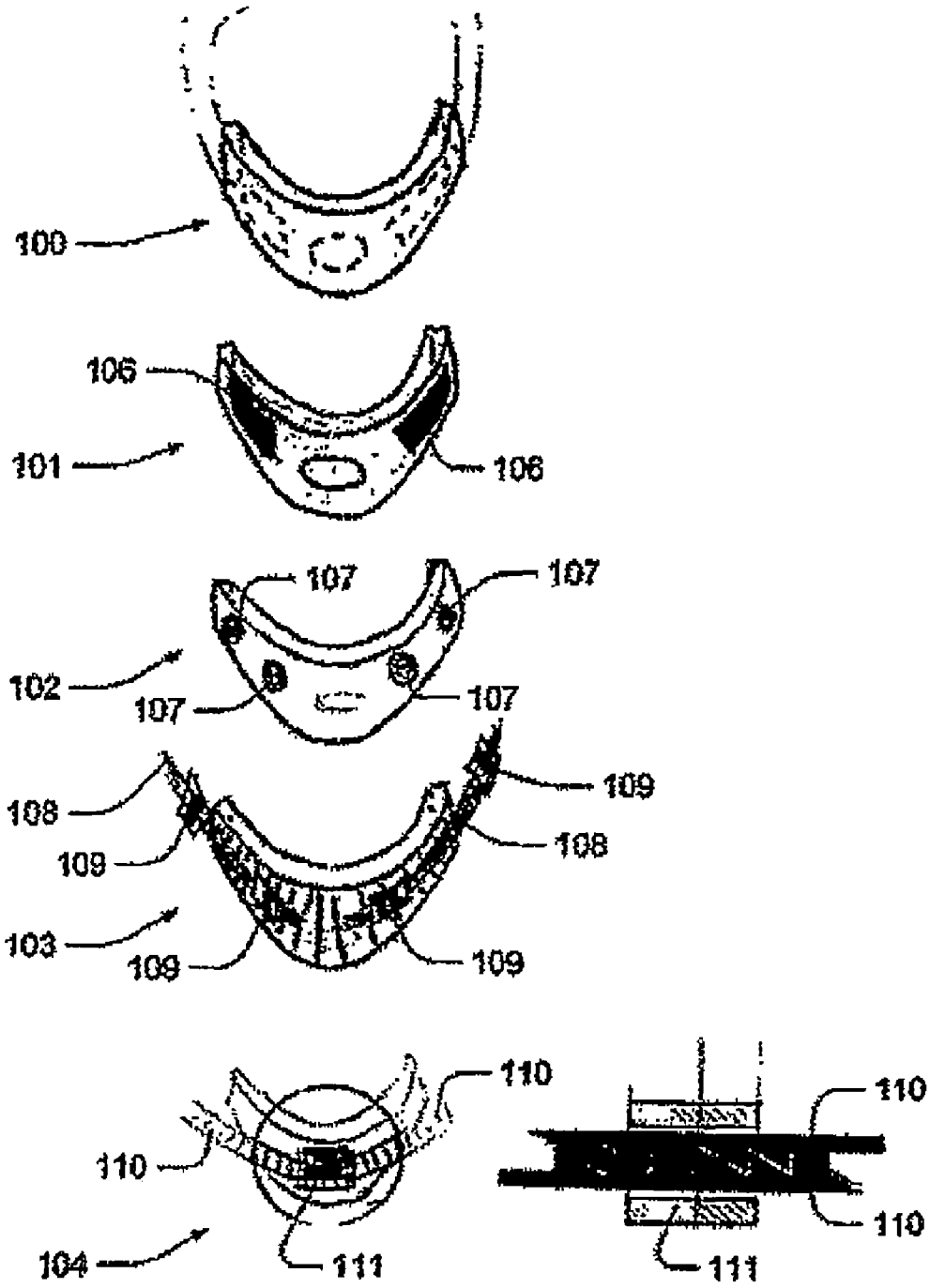
FIG. 25 illustrates some chin cups for use with en embodiment such as that of FIG. 24.

FIGS. 24 and 25 illustrate embodiments where fitting zone 14 is incrementally moveable to allow customized sizing for engagement with a particular person's chin region 11. In particular, fitting zone 14 is provided on a moveable chin cup that is shaped to cup a person's chin and in doing so restrict movement, for example about two or more axes. FIGS. 24 and 25 illustrate a plurality of alternate chin cup designs, which are discussed below. In general, a chin cup is a removable and adjustable component that, in use, retains and cups a wearer's jaw. In the present example the chin cup restricts forward movement of the chin to provide a snug fit, and also restricts vertical, horizontal and axial movement of the chin to retain this snug fit during activity. Chin cups are optionally formed from the likes of rubbers, plastics, poly carbons and PVC. Each chin cup includes a resilient material that compresses between a first surface for engagement with a user's chin and a second surface. This second surface is coupled, typically in a removable and adjustable manner, to a nearby portion of casing layer 25. In some embodiments the entire chin cup is pliable, although in other embodiments the second surface is, defined by a rigid casing formed from the likes of fiberglass, polycarbonates, Kevlar, plastics, and metals. Various embodiments of chin cups include:

Chin cup 100. This chin cup is selected from a plurality of like chin cups of incrementally varying sizes to suit a particular wearer. In some embodiments the chin cup is formed of a selectively mouldable material that is, for example) heated to allow moulding. This allows a chin cup to be custom shaped for a particular user's jaw structure, without the costs associated with customised foam injection.

Chin cup 101. This chin cup includes Velcro regions 106 for engagement with complementary Velcro regions on the interior of casing 25. It will be appreciated that once the Velcro portions are engaged, chin cup 101 is substantially resistant to movement other than purposeful removal. Importantly, forward and backward movement of the chin cup is substantially inhibited by the Velcro connection. In practice, to fit the chin cup a user implements a "trial and error" approach whereby the chin cup is inserted at various locations and the helmet subsequently tried on. The chin cup is then removed and replaced at a different position, and the process repeated until a good fit is experienced.

Chin cup 102. This is similar to chin cup 102 however, rather than using Velcro, alternate engagement formations in the form of press-studs 107 are used. Typically two press-Studs are provided on each side of the chin cup to inhibit rotation about the studs, and an array of press-stud receiving formations provided on casing 25 for providing alternate fitting positions.

Chin cup 103. This chin cup interfaces with casing 25 by way of complementary toothed straps 108 and latches 109. This allows the chin cup to be slidably moved along an adjustment path whilst the helmet is worn thereby to conveniently find a good fit even once the helmet is worn in the closed configuration. The use of such straps/latches means that the chin cup is releasably lockingly engagable at a plurality of locations on the adjustment path thereby to provide a respective plurality of selectable positions for the second fitting zone and in doing so provide a customizable fit. In the illustrated embodiment two latches 109 are provided at each side, although in some embodiments only one latch is provided at each side. It will be appreciated that where latches are to be mounted to the chin cup, it is preferable for these to be mounted to a rigid outer surface of that chin cup.

Chin cup 104. This chin cup again makes use of complementary toothed straps and latches, however in a fashion whereby toothed straps 110 interengage under influence of a latch 111. It will be appreciated that straps 110 are permitted to move only toward one another when latch 11 is in a closed configuration, and subsequently away from one another when latch 11 in an open configuration.

Figure 38:
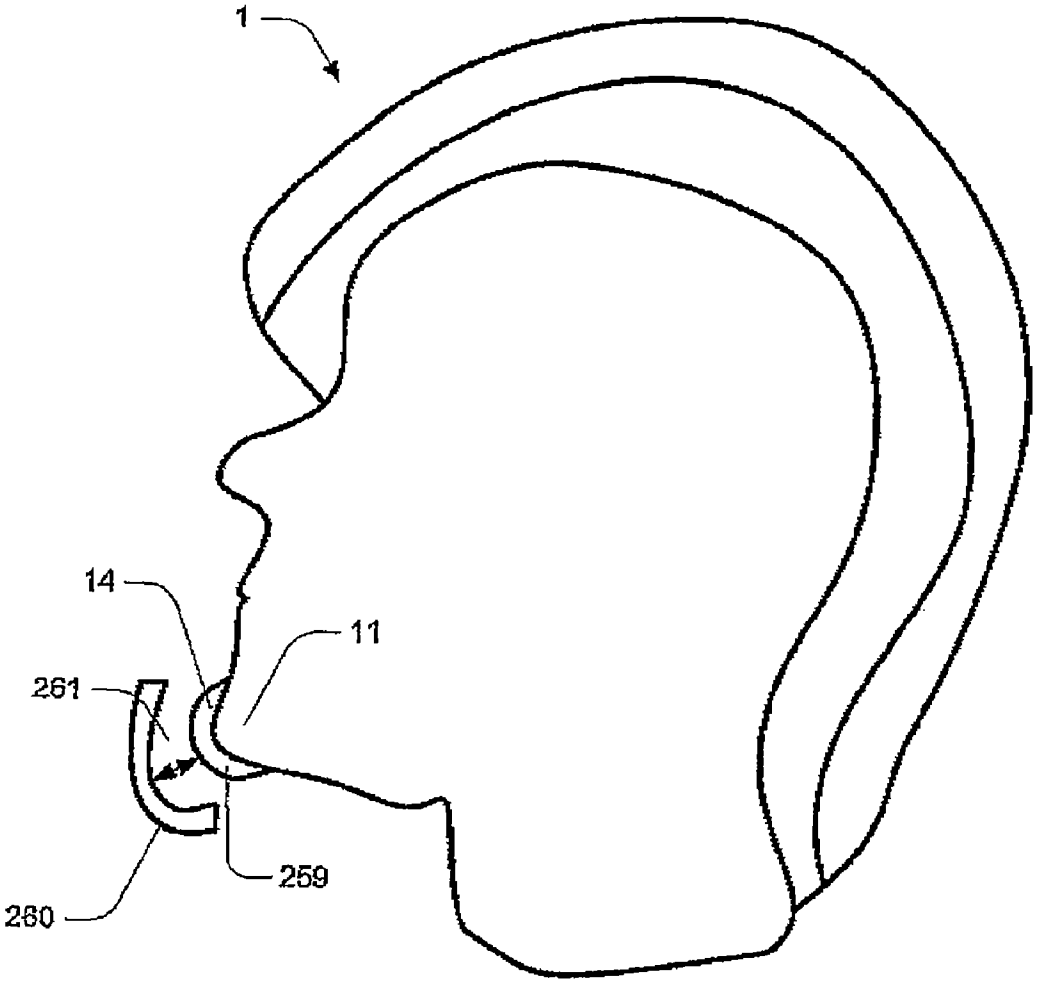
FIG. 38 is a schematic sectional view of a helmet, shown in the closed configuration on a head.

It is preferable to maintain at least a 5 mm to 25 mm spacing intermediate the outer side of a chin cup or other region for chin engagement and the hard shell at the front of the helmet. The rationale is to allow some limited but resiliently opposed movement of the jaw so as to reduce the risk of jaw injury from a frontal impact. That is, the jaw is able to move through a relatively small distance prior to being subjected to harsh resistance from the stiff outer shell of the helmet. In some embodiments this limited movement allows for the user to speak with less difficulty. An example is shown in FIG. 38 where zone 14 is provided on a chin cup 259. This chin cup is separated from the hard casing region 260 around the chin region by a cavity 261. Upon impact to region 260 the wearer's chin 11 moves with chin cup 259 in a resiliently limited manner in cavity 261.

Referring again to FIGS. 1 to 8, casing layer 25 defines an outermost surface substantially covering the helmet's exterior. This surface is substantially rigid and puncture resistant. Typically, this surface is defined by the material or materials used to form casing 25. In the present embodiment the materials are a woven and glassed blend of Kevlar and graphite. In other embodiments alternate materials are used; for example in embodiments where injection moulding is used in construction. Issues of materials and construction are discussed in greater detail further below.

Figure 22:
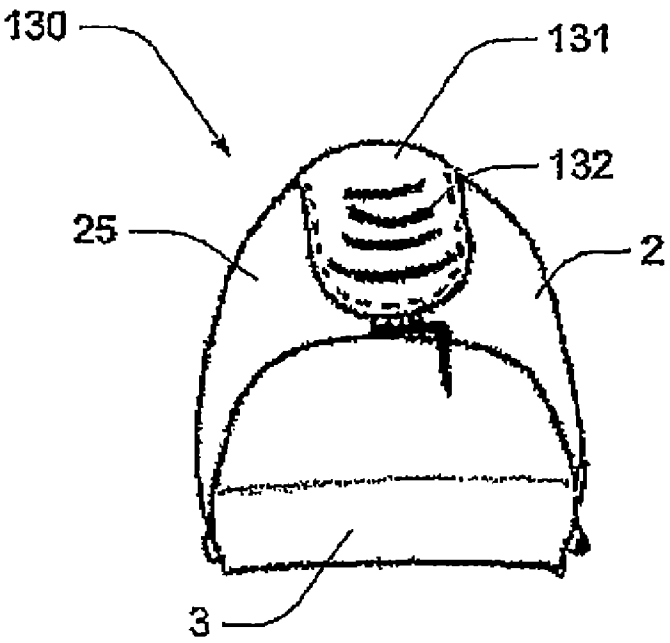
FIG. 22 is a rear view of the embodiment of FIG. 21.
Figure 21:
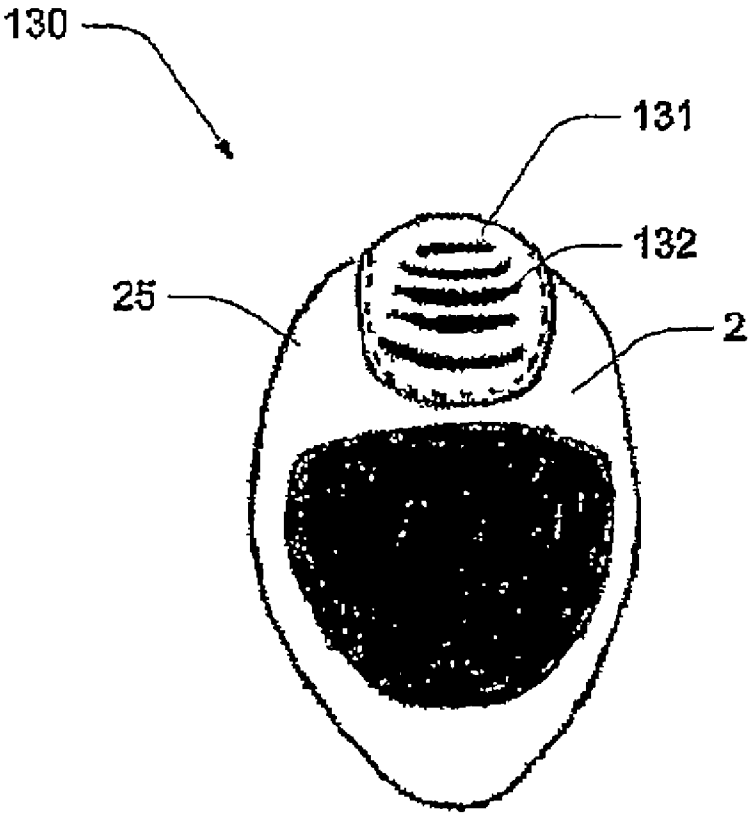
FIG. 21 is a front view of a helmet according to another embodiment.

Helmet 1 in the present embodiment retains a semblance of a known equestrian helmet. That is, because of the size and bulbous shape of portion 6 and relatively recessed nature of portion 7, helmet 1 retains general external geometrical properties of a known equestrian helmet. This is particularly useful in that it allows the mounting of known coverings such as skins previously used for rider identification in competitive events. Further, it inherently provides closer conformity with existing equestrian helmet safety standards that may be in place. It will be appreciated that helmet 1 at least arguably exceeds such standards given the additional protection provided to the cheeks, jaw, and chin. In some embodiments, including other embodiments intended for equestrian applications, the bulbous shape is set aside in favour of a more streamlined profile, for example as is shown in FIGS. 21 and 22. In some instances this more streamlined appearance is thought to be more aesthetically pleasing.

The outer surface of casing 25 substantially provides a predetermined deflection angle. Typically this angle is between 30 and 60 degrees, and in the present embodiment it is about 45 degrees. This is particularly useful in equestrian activities given the desire to deflect an incoming hoof, however it is similarly useful in other applications. It will be appreciated that not every point on the casing need to precisely provide this deflection property, however the casing substantially provides the property as a whole. The level of deflection protection warranted or required is in some situations a matter of preference, or in other situations set by an independent standard.

Shells 2 and 3 are lockingly engagable by a multiple point locking system, in this embodiment being a three point locking system. This locking system involves three discrete components: a dorsal hinge assembly 2S, and two side binding-type connection mechanisms 29.

Hinge assembly 28 hingedly connects shell 2 to shell 3 such that movement of the shells between helmet configurations generally involves relative rotation about an axis defined by hinge pin 30. When the helmet is in the closed configuration, assembly 28 is substantially contoured with the surface of the helmet. That is, assembly 28 does not substantially protrude to affect the overall deflection angle of the helmet. Further, where hinges protrude there is a risk of hoof impact breaking the joint and unintentionally releasing helmet 1 from head 4.

Figure 7:
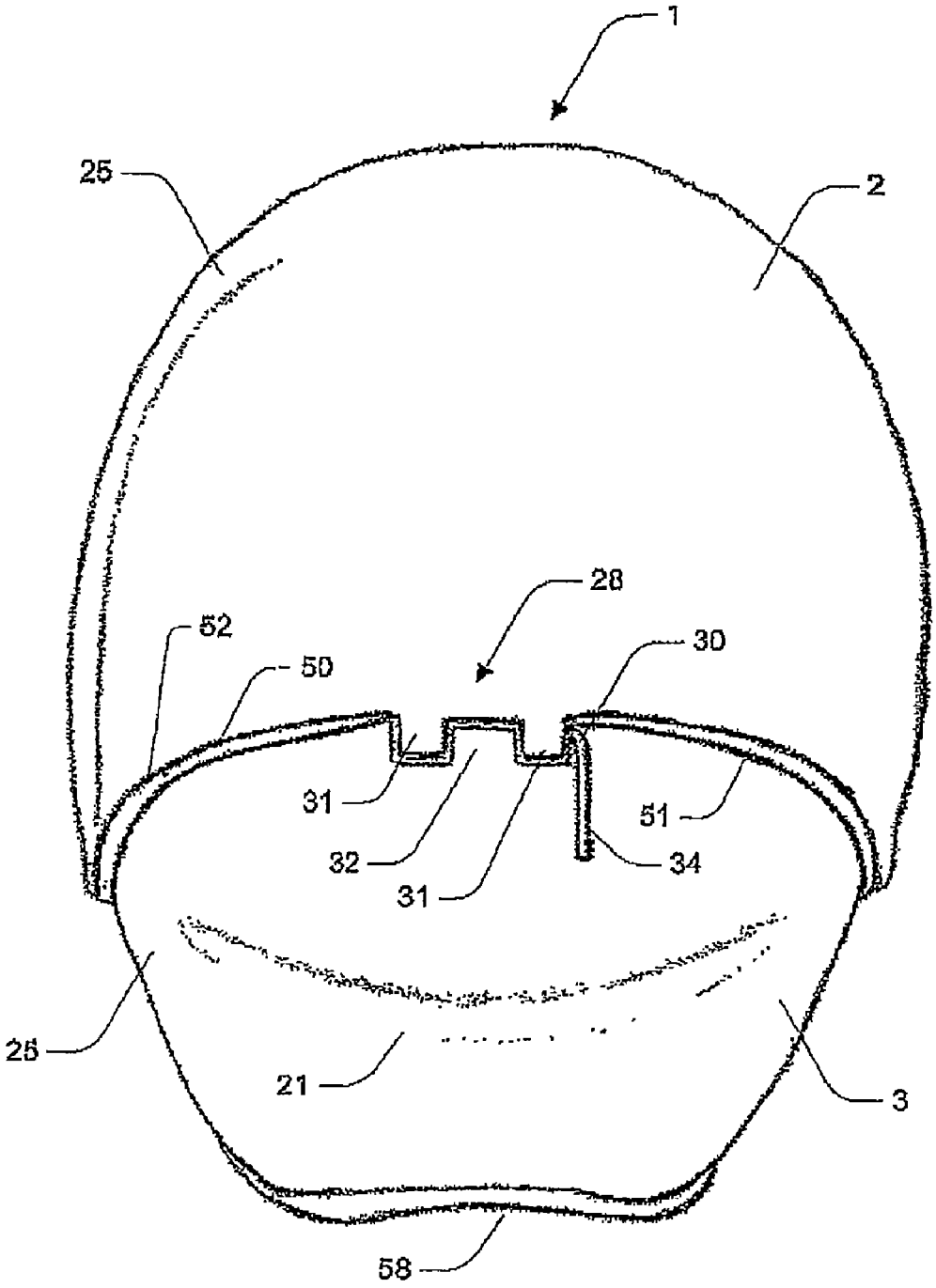
FIG. 7 is a rear view, of the helmet of FIG. 1, shown in the closed configuration.
Figure 8:
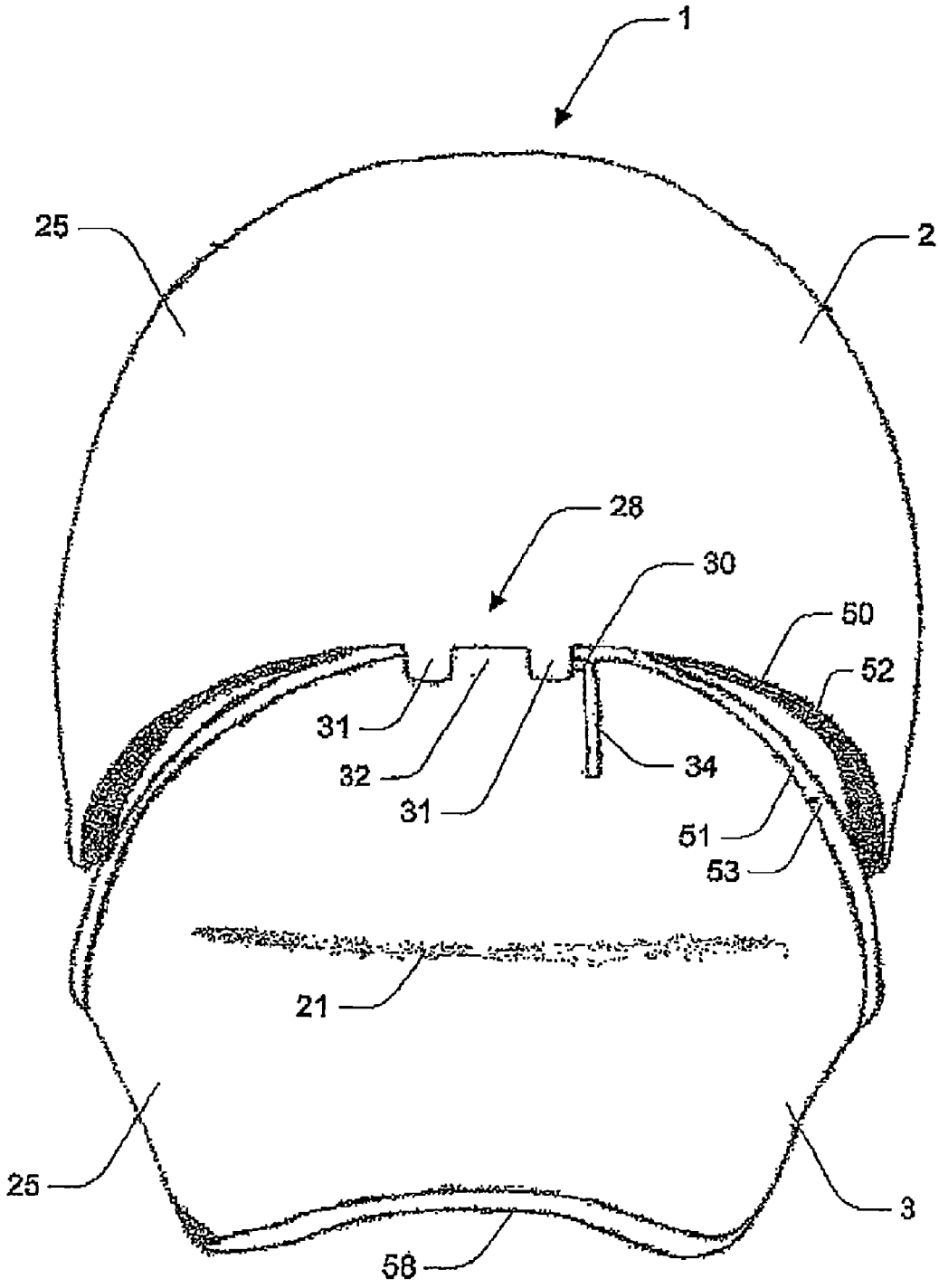
FIG. 8 is a rear view of the helmet of FIG. 1, shown in the Open configuration.
Figure 9:
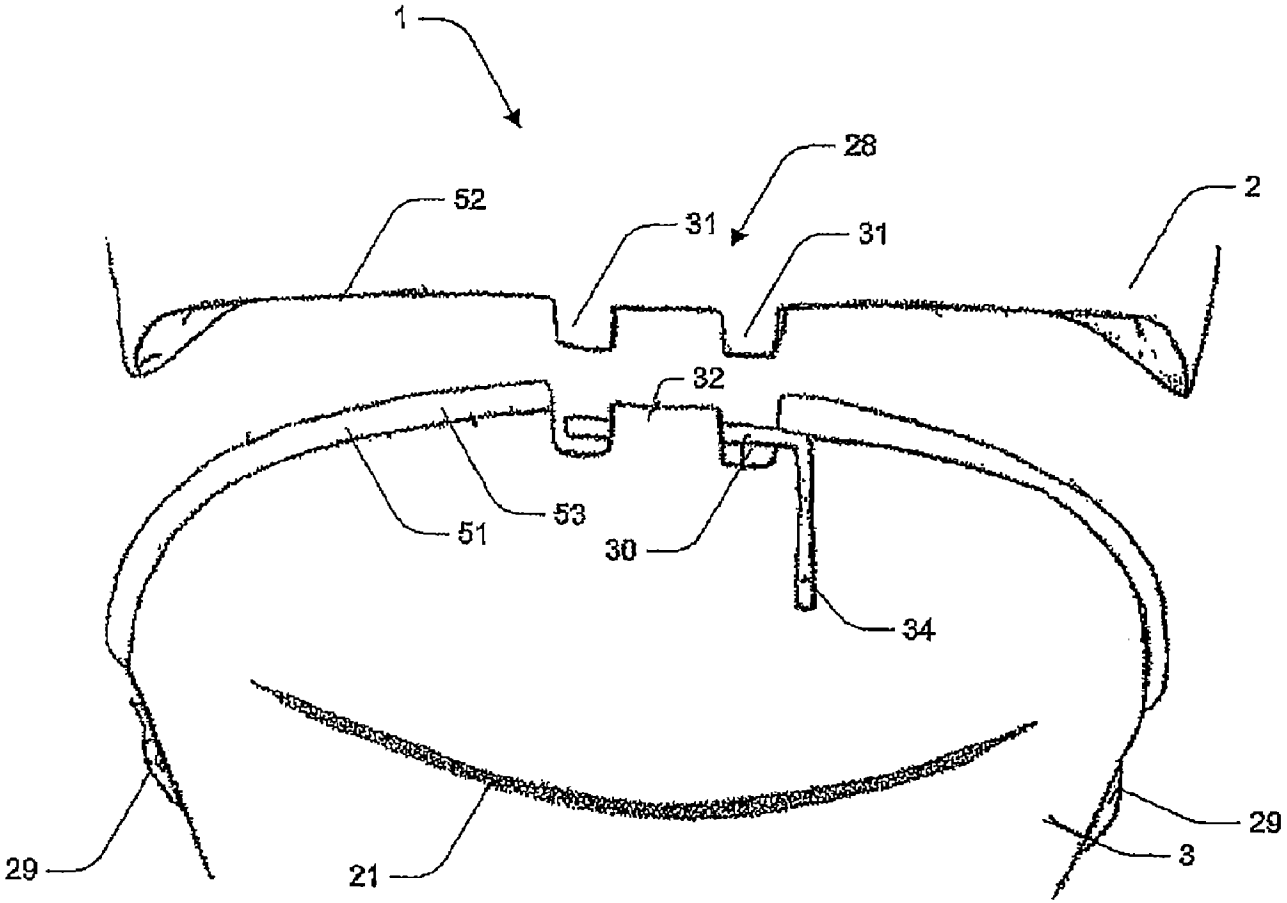
FIG. 9 is a an enlarged view similar to FIG. 8, however showing the helmet separated into two shells.

Hinge assembly 28 includes pin-receiving formations 31 and 32 respectively integrally formed with shells 2 and 3. These formations include respective coaxially positionable apertures for receiving hinge pin 30. Each pin-receiving formation extends in substantially constant contour with respect to an adjacent area of the respective shell, as best shown in FIGS. 7 to 9.

More precisely, shell 2 includes two formations 31 which, in use, coaxially sandwich a complimentary formation 32 of shell 3. Pin 30 is inserted through the respective apertures to define the hinged connection. In other embodiments formations 31 are provided on shell 3 and formation 32 on shell 2.

In the illustrated embodiment pin 30 includes a bent end portion 34 for convenient finger engagement to facilitate the extraction of pin 30. This, in turn, facilitates complete separation of the shells. This is practically useful in situations where it is necessary to remove helmet 1 from head 4 either urgently or with extreme caution—following an accident, for example. In particular, removal of helmet 1 by complete separation of shells 1 and 2 is typically preferable where spinal injuries are suspected.

In use, end 34 is maintained within a specially formed receiving channel 35 such that the general external contour of casing 25 is substantially unaffected. In some embodiments a cover (not shown) is provided for end 34 to reduce the risk of accidental or recalcitrant extraction of pin 30. In some cases this cover is only removable once and not replicable. This provides evidence of tampering or pin extraction. For example, the cover is removed following an accident to indicate that helmet 1 is no longer suitable for future usage.

In some embodiments pin 30 is not conveniently removed, for example in embodiments where more traditional hinging techniques are used. These embodiments preferably make use of a similar integrally formed and smoothly contoured hinge assembly 28 to retain the associated advantages.

In other embodiments alternate dorsal hinge assemblies are used as alternatives to the present dorsal hinge assembly 28. Some examples are provided in FIGS. 30 to 33, which are described further below.

Figure 30:
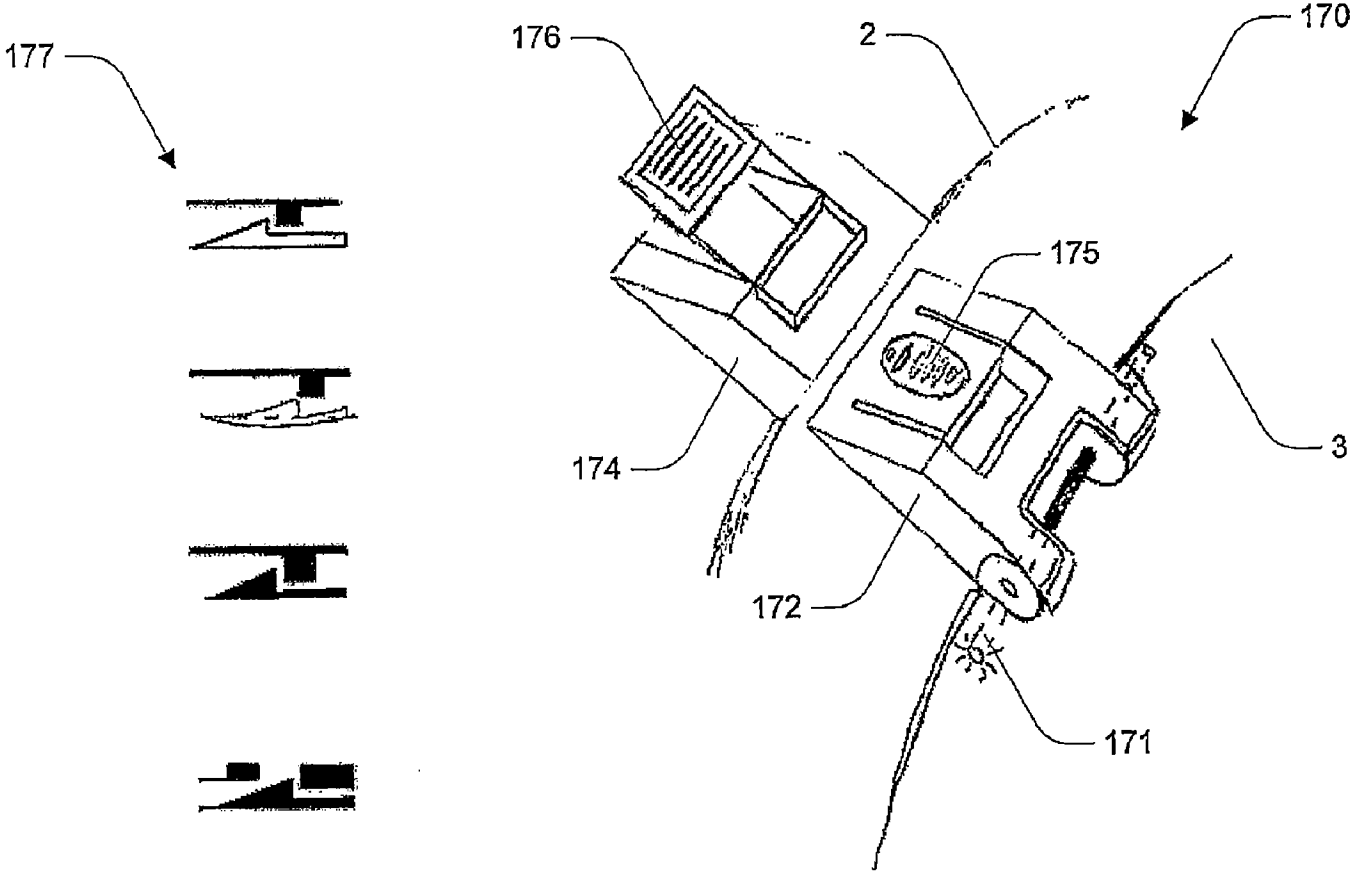
FIG. 30 illustrates a hinge assembly according to a further embodiment.

FIG. 30 illustrates a hinge assembly 170. A hinge pin 171 is provided in shell 3 for defining an axis of rotation between shells 2 and 3. This hinge pin rotatably connects a latch member 172 to hinge pill shell 3. Latch member 172 is releasably lockingly engageable with a complementary catch member 174, which is ideally embedded or countersunk in shell 2. Latch member 172 is inserted into catch member 174 to securely and rotatably connect shells 2 and 3 to allow opening and closing of the helmet. Additionally, pressing region 175 allows the latch member to be removed, and as such shell 2 to be separated from shell 3. Region 175 is optionally covered by a sliding cover 176. View 177 shows in greater detail various detailed connection options for embodiments of latch 172 and catch 174. It will be appreciated that the catch/latch components shown are exemplary only, and in other embodiments other catch/latch components are used as an alternative. That being said, in some embodiments important considerations applied to the selection of appropriate catch/latch components include the ability to retain the catch and latch within the helmet whilst in use. That is, the rear of the helmet should remain substantially smoothly contoured to reduce the risk of a catch or latch being subjected to impact, being damaged, and leading to the connection between helmet shells losing integrity.

Figure 31:
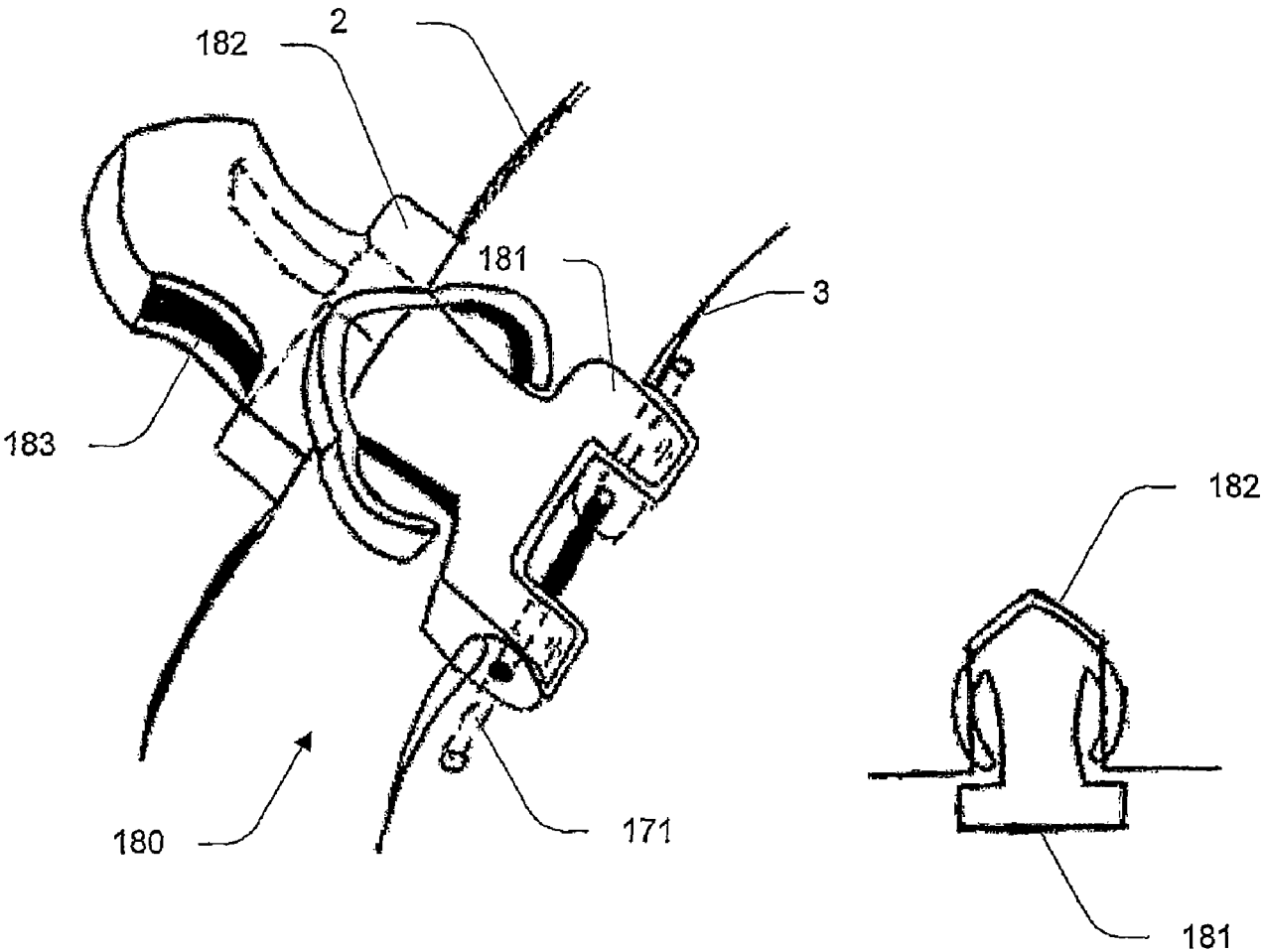
FIG. 31 illustrates a hinge assembly according to a further embodiment.

FIG. 31 illustrates a similar hinge assembly 180. Assembly 180 again includes a hinge pin 171 in shell 2, however this embodiment makes use of a butterfly clip 181 for insertion into a complementary embedded receiving fitment 182 in shell 2 as an alternate latch/catch arrangement. Countersunk finger engagement portions 183 are used to selectively manually release clip 181 from fitment 182.

Figure 32:
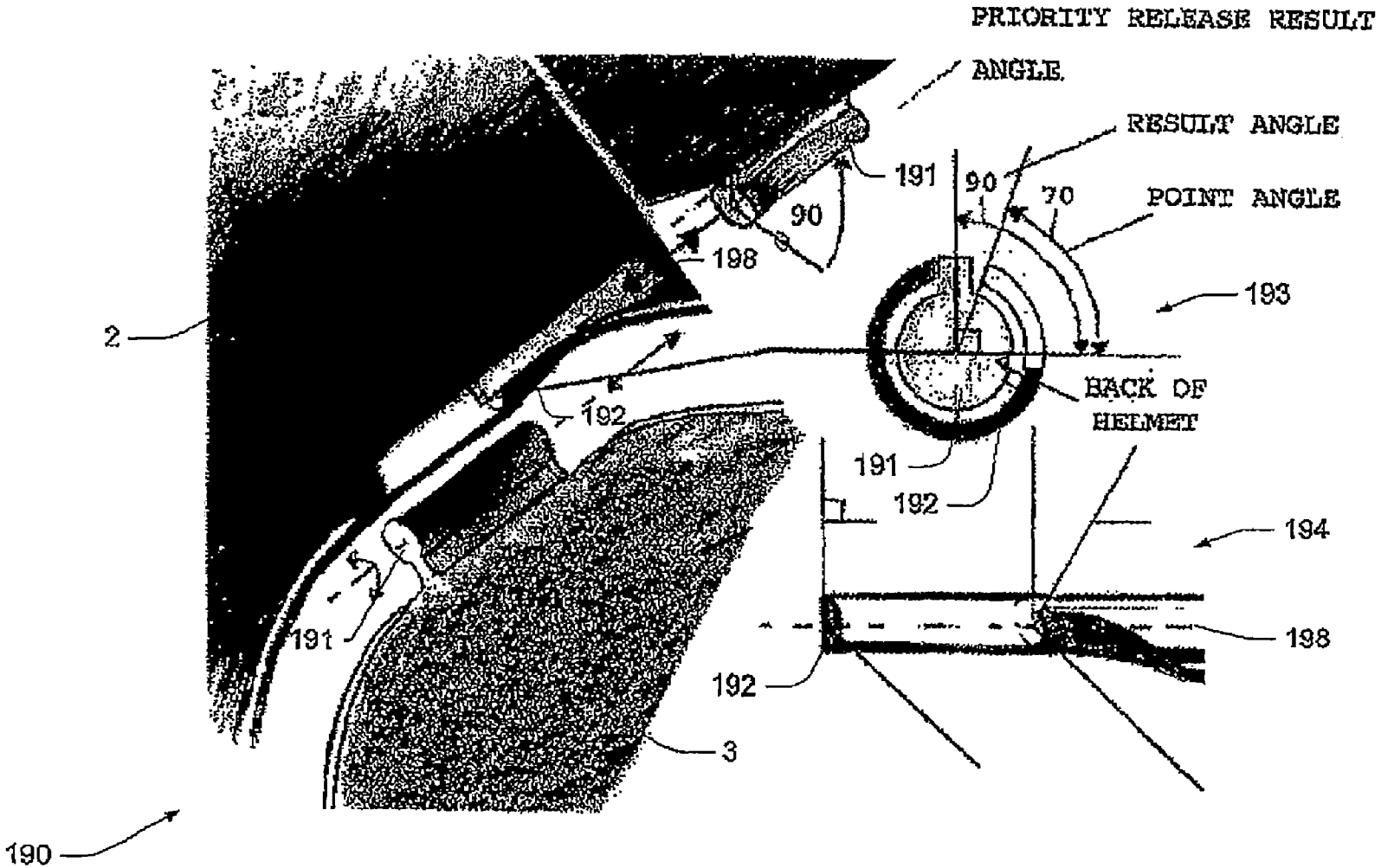
FIG. 32 illustrates a hinge assembly according to a further embodiment.
Figure 33:
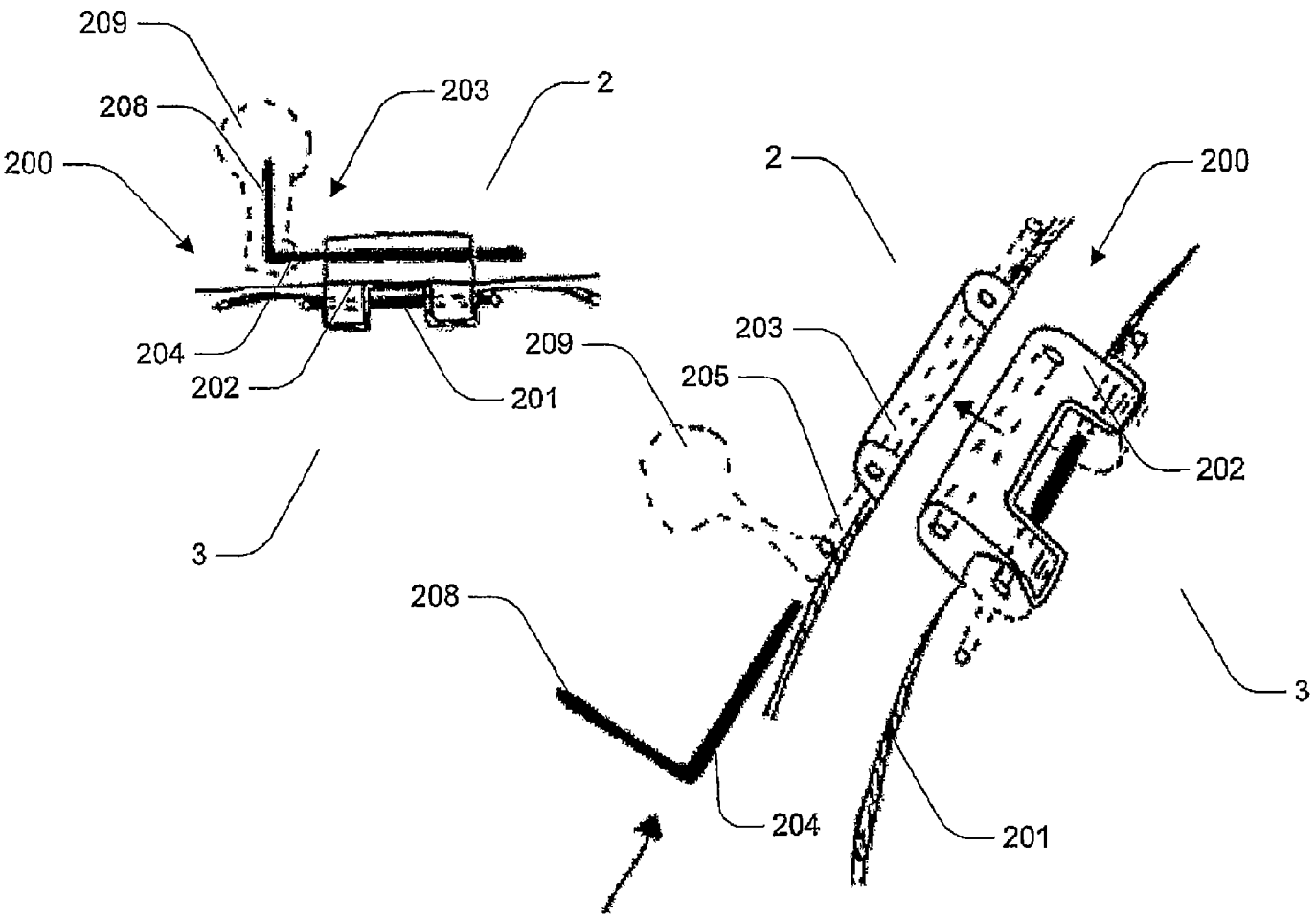
FIG. 33 illustrates a hinge assembly according to a further embodiment.

FIG. 32 illustrates a pinless hinge assembly 190. In this embodiment a hinge member 191 is integrally formed from shell 3. This hinge member is insertable into a complementary integrally formed hinge-receiving channel 192 on shell 2. As best shown in views 193 and 194, hinge member 191 is insertable into and removable from channel 192 when shell 2 and shell 3 are disposed in a predefined angular configuration. Importantly, the hinge member is not removable when the shells are in or close to interlocking engagement. In use, hinge member is slidably inserted into channel 192 from an end 198. Upon complete sliding engagement, the element shells are able to be rotated relative to one another to open and close the helmet. To remove the hinge, the helmet is opened and the shells rotated sufficiently to allow sliding withdraws of hinge member 191 from channel 192.

Figure 34:
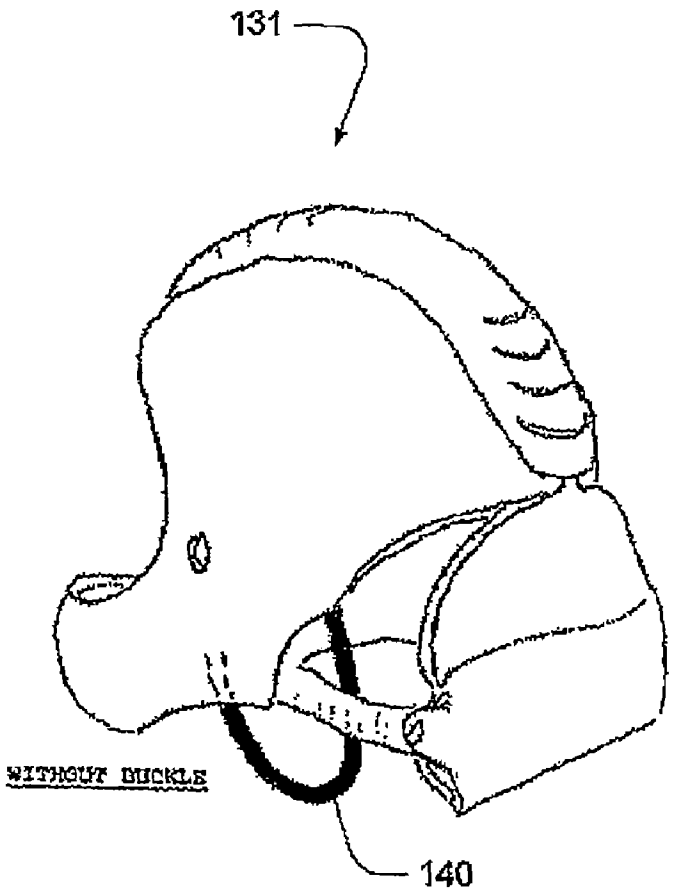
FIG. 34 illustrates a helmet including a chinstrap.

FIG. 34 illustrates a hinge assembly 200. Assembly 200 provides a double hinge removable pin-hinge emergency removal system. In overview, assembly 200 includes a first hinge pin 201 in shell 3 about which shell 2 is rotatable in use. A dual-hinge member 202 is rotatably connected to shell 3 at hinge pin 201. This member 202 is inserted into a receiving channel 203 in shell 2, at which time a removable hinge 204 is insertable though an aperture 205 in shell 2, and subsequently though member 202, thereby to secure shell 2 to shell 3 in a rotational configuration about hinge pin 201. It will be appreciated that there is no significant rotation at hinge 204. Rather, hinge 204 is a removable hinge that is optionally removed in emergency situations to facilitate convenient removal of the helmet form a wearer. Hinge 204 includes a bent end portion 208 which in use is maintained in a recess 209.

Referring again to FIGS. 1 to 8, each side connection mechanism 29 designates a selectable proximity between adjacent connector regions 38 of shells 2 and 3. In the present embodiment the hinged connection dictates that the proximity is substantially equal on each side.

Each mechanism 29 resembles a mechanism commonly used in relation to snowboard bindings. That is, each mechanism 29 includes a binding latch 40 and complementary corrugated binding strap 41. Strap 40 is rotatably mounted with respect to shell 2 such that it is able to remain within binding latch 40 upon relative hinged rotation of the shells.

Each binding latch 40 is moveable from a locked configuration in which the allowed passage of strap 41 is unidirectional and an unlocked configuration in which the allowed passage of strap 41 is bi-directional. It will be appreciated that helmet 1 is movable into the closed configuration regardless of the configuration of each binding latch 40. However, to conveniently move helmet 1 out of the closed configuration it is necessary to have both bindings 40 in the unlocked configuration. This further reduces the risk of accidental removal of helmet 1.

As the helmet closes, binding strap 41 progresses through binding latch 40 to define a tail portion 43. An aperture 48 is provided on stepped region 20 such that tail portions 43 are received in the interior of helmet 1. A tunnel 49 is provided for receiving and concealing the tail portions. In some embodiments, the tunnel is defined by an inner shell mounted to and formed independently of the rear shell. The rationale for independent formation is a matter of construction and will be understood by those skilled in the art.

The described locking system should not be regarded as limiting in any way, and alternate locking systems are used in other embodiments. For example, in some embodiments shells 2 and 3 are adapted for resilient snap-locking engagement. In other embodiments a tie is used to maintain the helmet in the closed configuration. In one embodiment three binding-type mechanisms are used, the third of these replacing hinge assembly 28. In some cases latches 40 and straps 41 are reversed between the shells. Those skilled in the art will understand and readily implement these and other alternate locking mechanisms.

Figure 10:
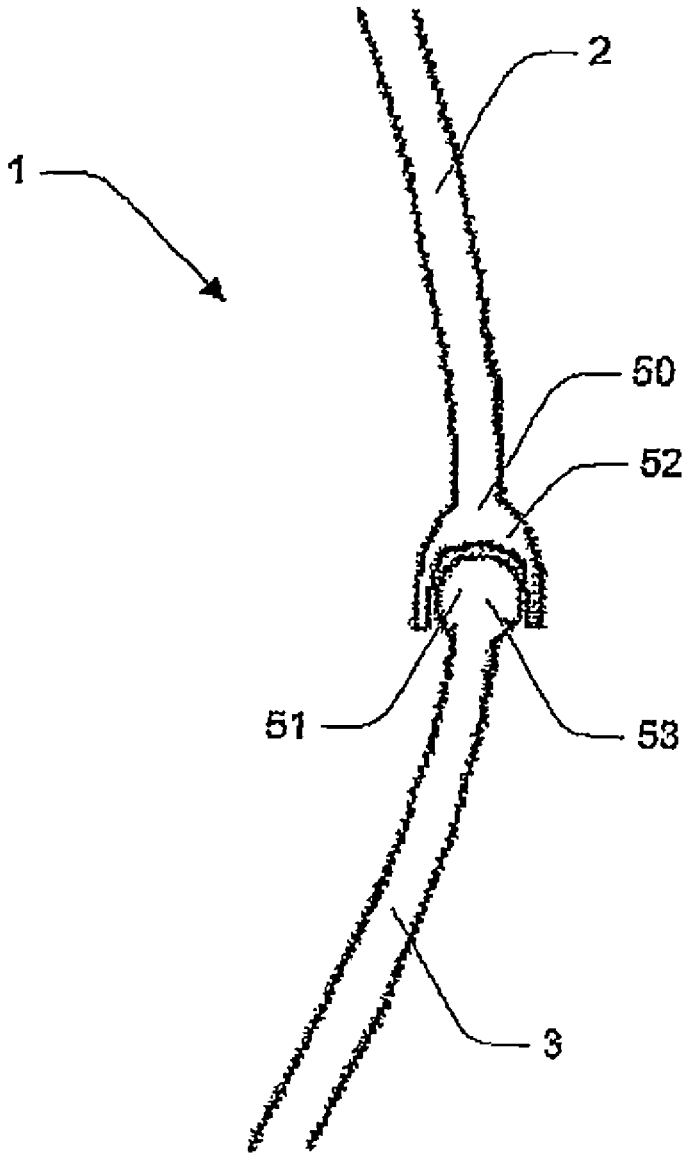
FIG. 10 is a transverse sectional view of edges 50 and 52 of the helmet of FIG. 1, shown in the closed configuration.

Shell 2 includes a first edge 50 complimentarily engageable with a second edge 51 on shell 3. Edges 50 and 51 include respective complimentary interengaging locating formations 52 and 53. These extend substantially along the length of edges 50 and 51, generally speaking from the stepped region 20 on one side to the stepped region 20 on the other side, with a brief gap at the location of hinge assembly 28. Formations 52 and 53 are locatingly engaged when the helmet is in the closed configuration to substantially transversely locate the front shell with respect to the rear shell. It will be appreciated that this increases the structural rigidity of helmet 1 when in the closed configuration. Formations 52 and 53 are defined by the cross-sectional profiles of their respective edges 50 and 51. This is best shown in FIG. 10.

Formation 53 is in the form of a beaded peripheral lip on edge 51. Formation 52 defines a recessed peripheral channel along edge 50 for receiving the beaded lip. In this embodiment the lip does not snap lockingly engage within the channel, however movement is substantially restricted due to close conformity of components. In one embodiment, the beaded lip has a maximum width dimension of about 7.5 mm and the cannel has a diameter of about 9 mm. The channel is about 9mm deep, and the lip is of slightly less depth.

It will be appreciated that alternate positioning or selection of mechanisms 25 facilitates extension of formations 52 and 53 beyond stepped region 20. For example, by mounting straps 41 to the exterior of shell 2.

Figure 20:
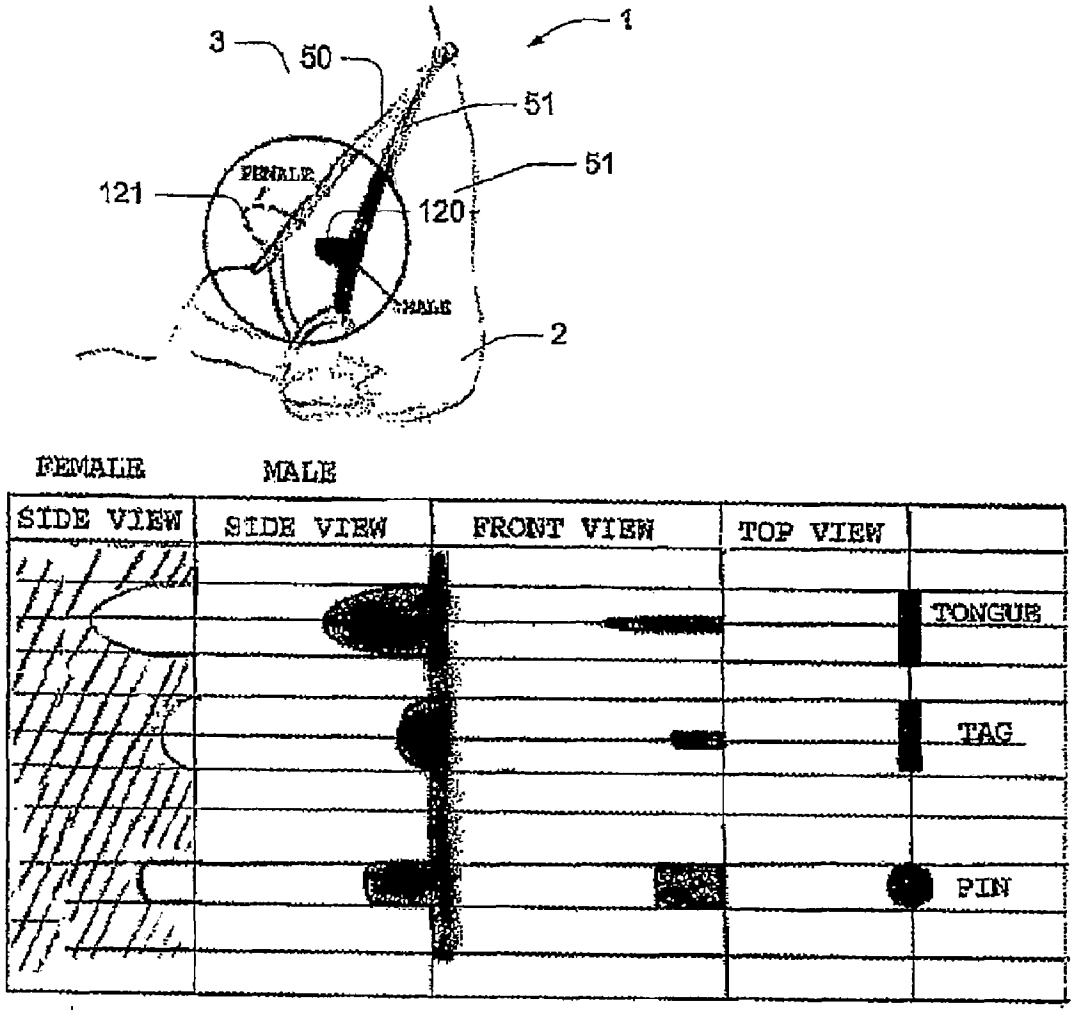
FIG. 20 illustrates a locking technique and various alternative configurations thereof.

FIG. 20 illustrates an embodiment of helmet 1 wherein a locating formation 120 is provided on edge 51 for engagement with a complementary fitment 121. Upon interengagement of formations 52 and 53, locating formation 120 is engaged with fitment 120 to define a male/females interlocking combination and thereby to provide an increased structural rigidity to the helmet when in the closed configuration. In such embodiments helmet 1 typically includes a symmetrically disposed pair of formations 120 for engagement with a corresponding pair of fitments 121, and in some cases multiple pairs of each. FIG. 20 also shows three alternate configurations for formation 120 and fitment 121 that are used in various embodiments. It will be appreciated that other configurations are used in further embodiments, including but not limited to cases where the formations 120 are provided on edge 50 and fitments 121 provided on edge 51.

Figure 18:
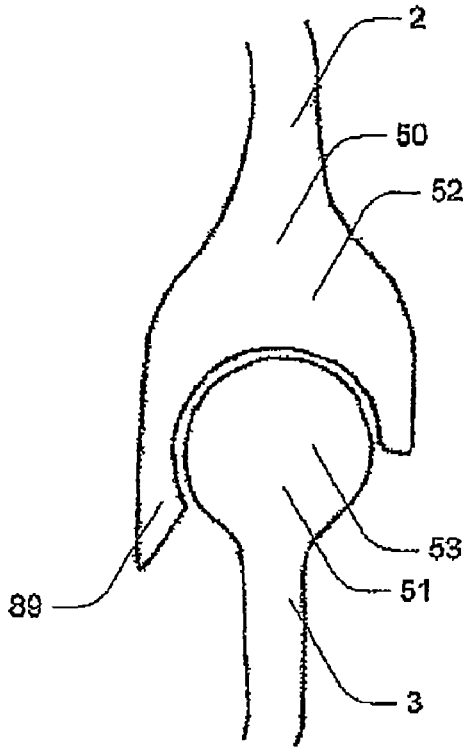
FIG. 18 is a transverse sectional view of edges 50 and 52 of a helmet according to a still further embodiment, shown in the closed configuration.
Figure 19:
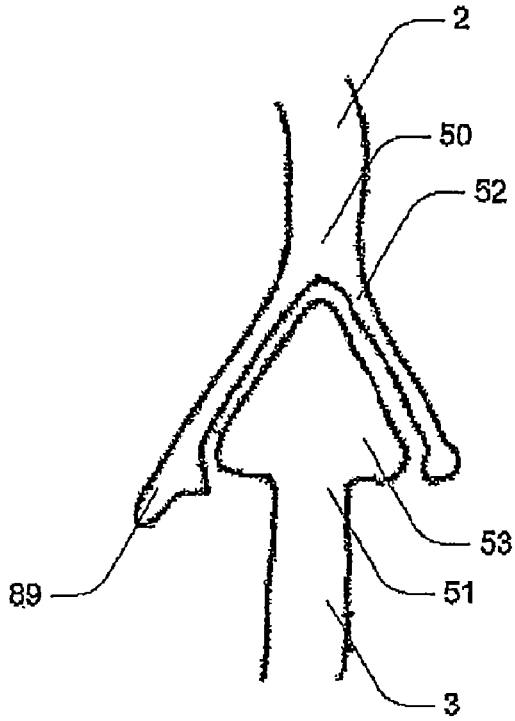
FIG. 19 is a transverse sectional view of edges 50 and 52 of a helmet according to a still further embodiment, shown in the closed configuration.

Variations of formations 52 and 53 are used in other embodiments, such as those illustrated in FIGS. 18 and 19. These embodiments make use of an extending retaining section 89 on formations 52. FIG. 19 makes use of a formation 53 having a rounded-edged triangular cross-section, and formation 52 is adapted accordingly. Further examples are illustrated in FIGS. 27 to 29.

Figure 27:
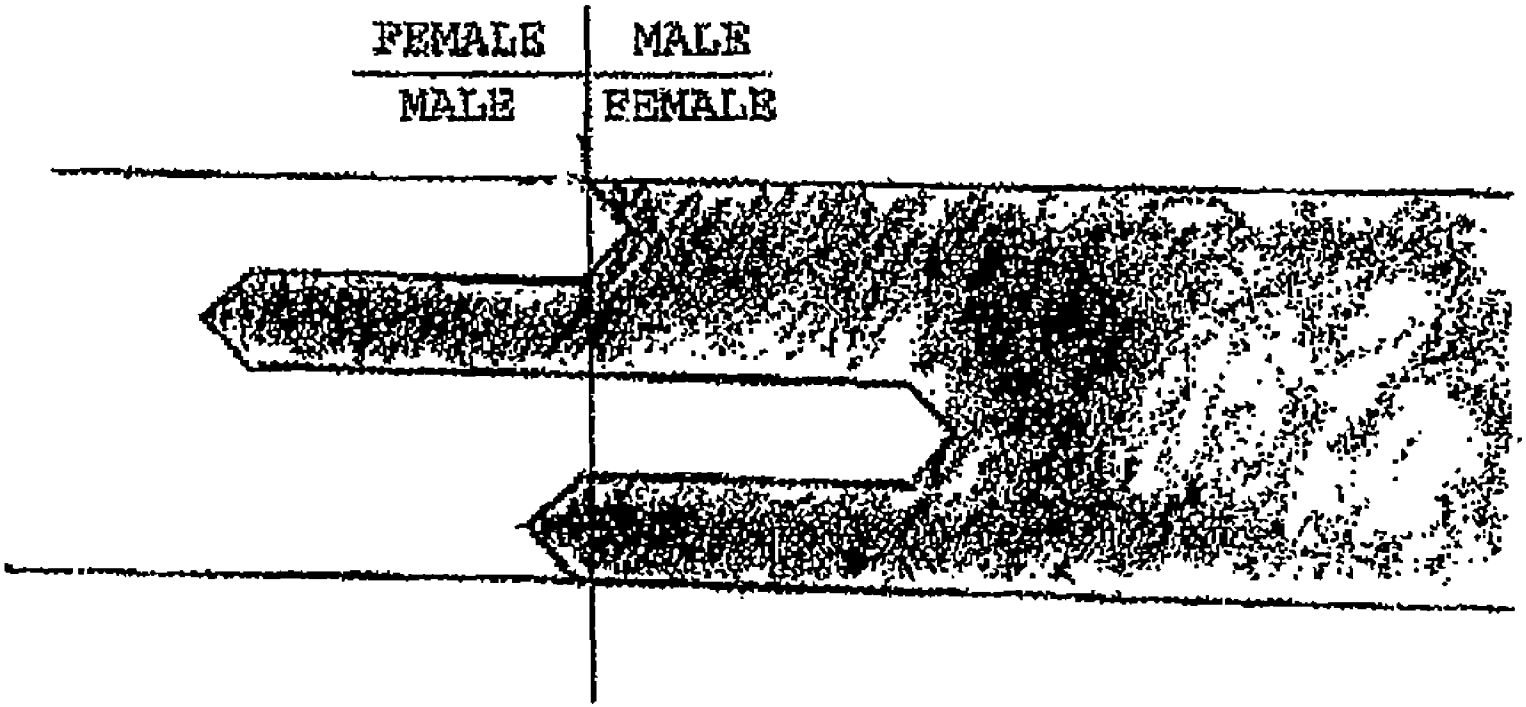
FIG. 27 illustrates an interlocking edge configuration according to a further embodiment.
Figure 28:
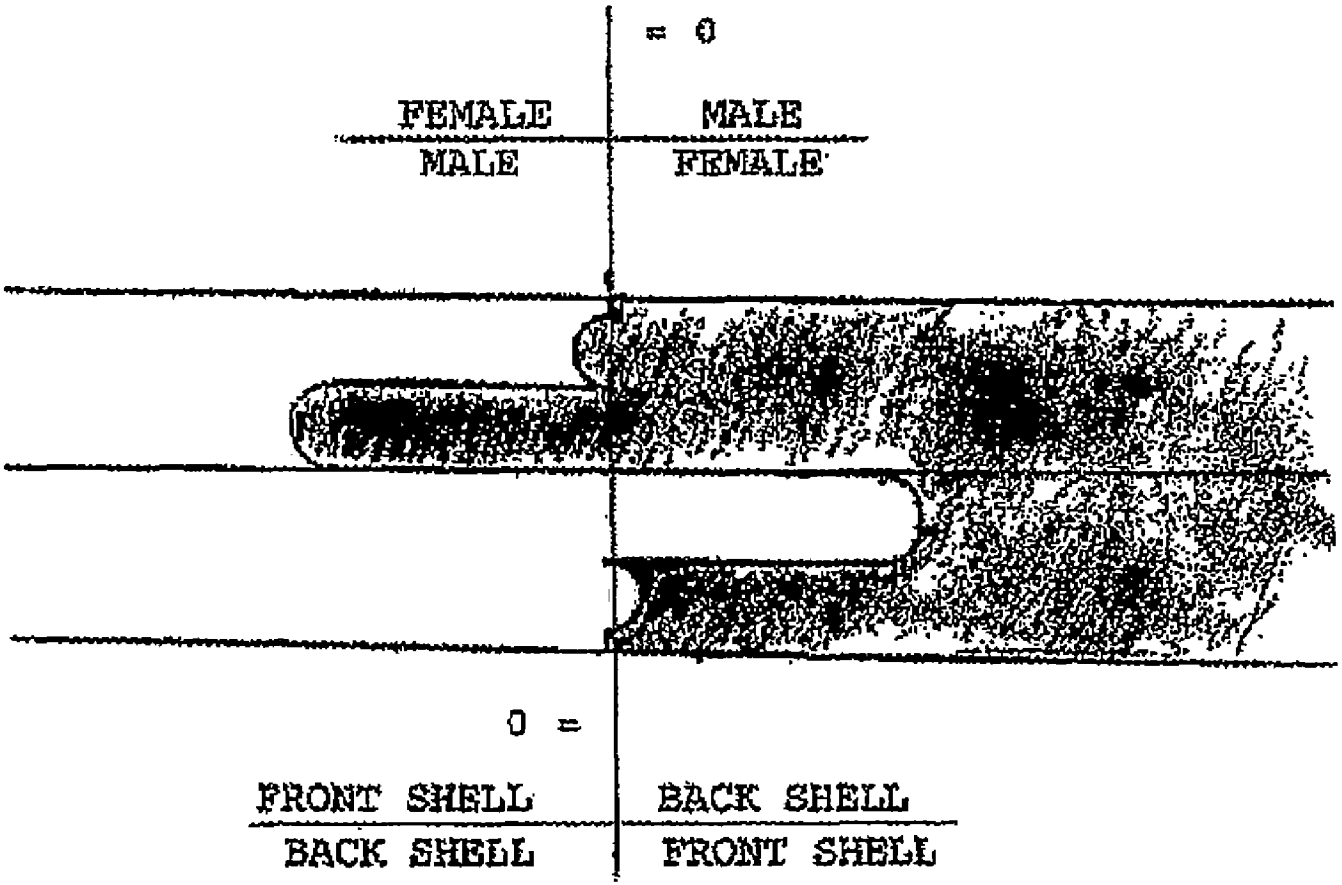
FIG. 28 illustrates an interlocking edge configuration according to a further embodiment.
Figure 29:
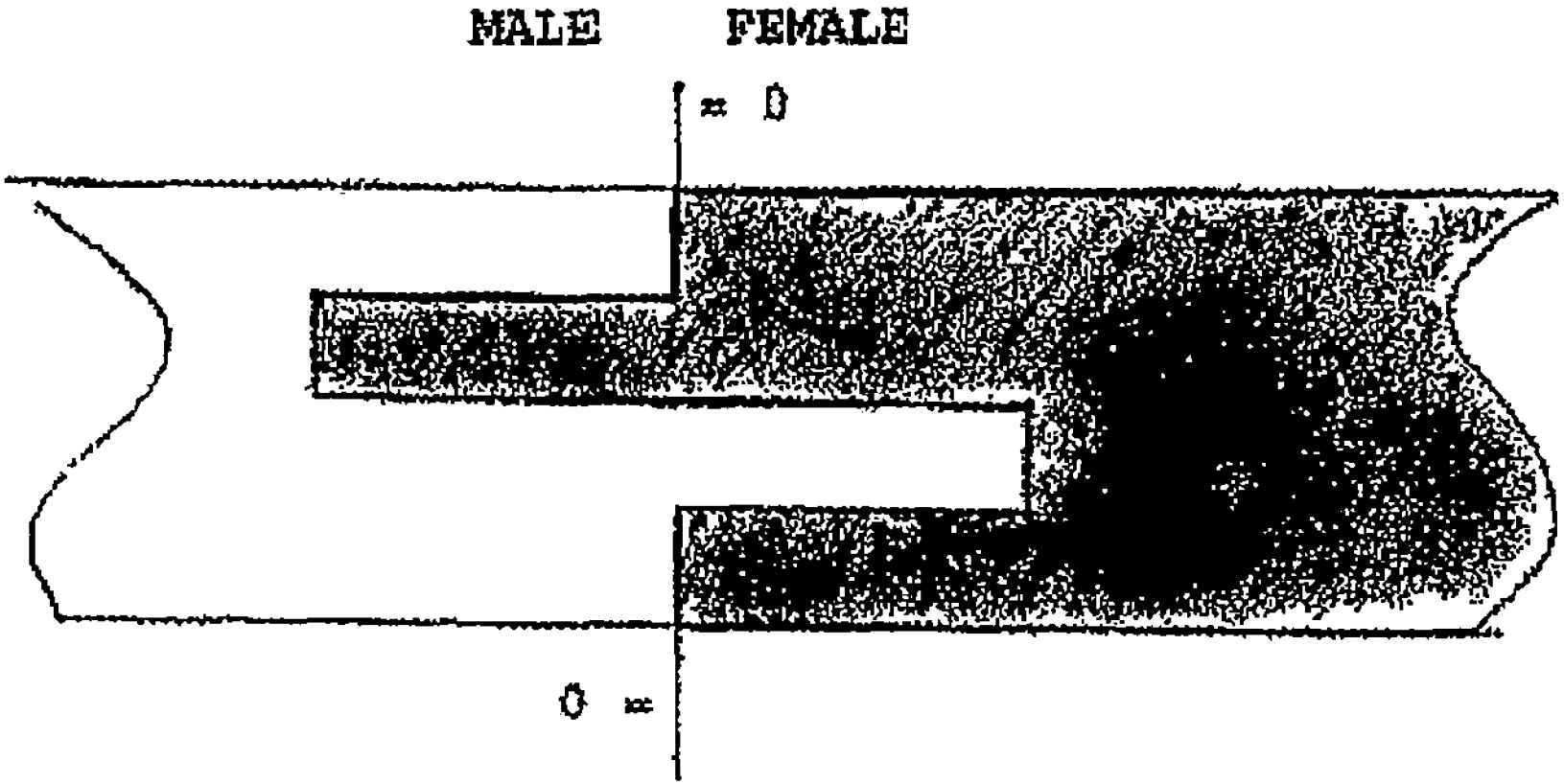
FIG. 29 illustrates an interlocking edge configuration according to a further embodiment.

FIGS. 27 to 29 illustrate alternate configurations for interengaging locating formations 52 and 53 of helmet 1 above. Each of these figures show a cross section of engaged locating formations that, in the context of a helmet such as helmet 1, define interlocking edges for the front and rear shells. It will be appreciated that in some instances the locating formations are varyingly angled along the length of their respective edges to facilitate interlocking engagement of the edges.

FIG. 27 illustrates a configuration making use of overlapping double, interlocking edges. Each edge includes a male portion and a female portion, these engaging with corresponding female and make portions on the other edge. In this example each male potion includes a pointed tip that upon engagement conforms to a correspondingly shaped recess on a female member.

FIG. 28 shows another embodiment where the locating formations provide an overlapping double interlocking edge. In this example each male potion includes a curved tip that upon engagement confirms to a correspondingly shaped recess on a female member.

FIG. 29 shows another embodiment where the locating formations provide an overlapping edge. This is similar to the examples of FIGS. 27 and 28, however the male and female portions have complementary flat faces that come into conformity upon interlocking engagement of the edges.

Figure 37:
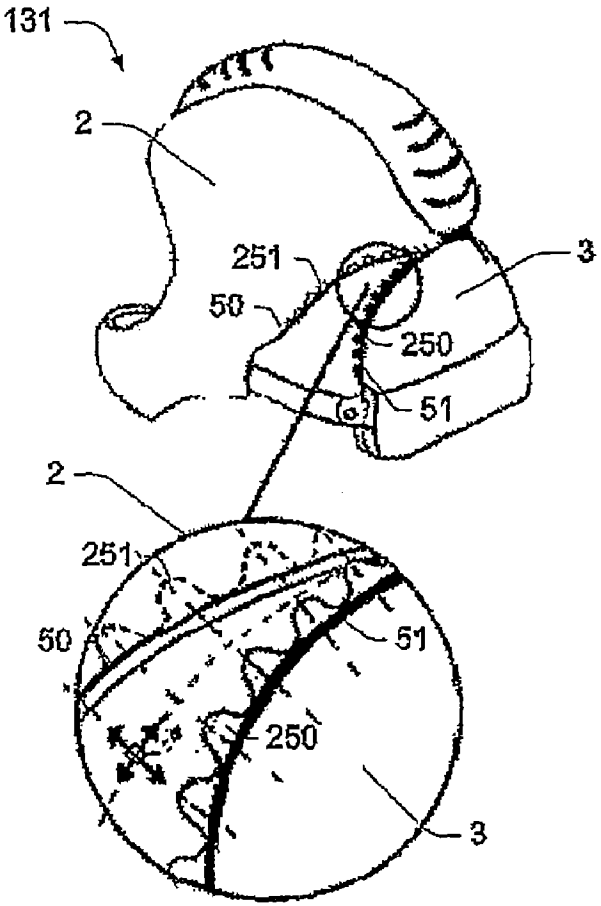
FIG. 37 illustrates a further locking technique.

Another interlocking edge arrangement is provided in FIG. 37. In FIG. 37 edge 51 includes a plurality of engagement teeth 250, which in the illustrated embodiment are smoothly joined to provide a wave design. Complementary receiving formations 251 are provided on edge 50. By this approach the rear and front shells are able to be uniquely locked in a manner to substantially prevent rolling or sliding of shells 2 and 3 with respect to one another.

Figure 14:
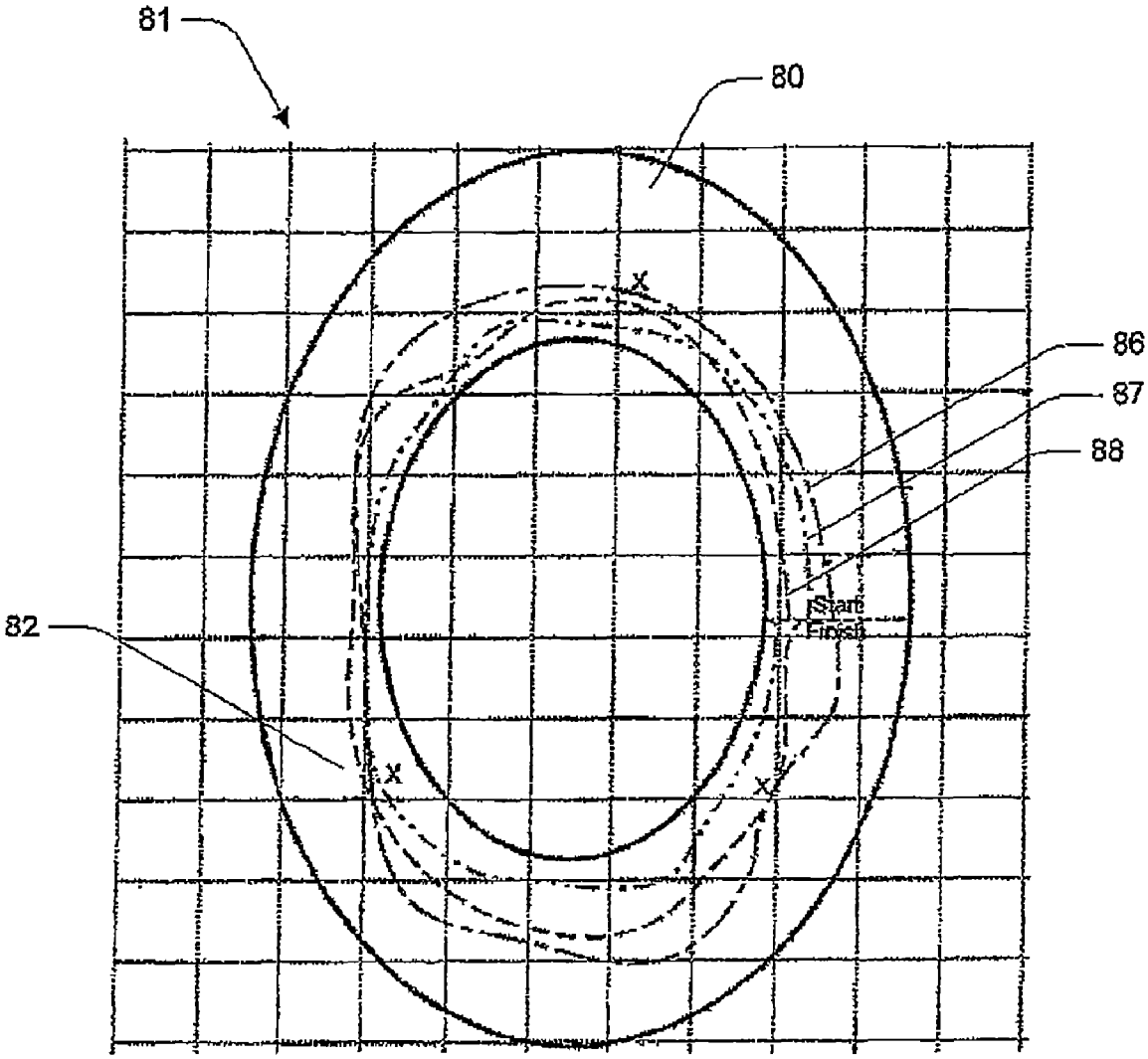
FIG. 14 is a schematic representation of a GPS based protest system.
Figure 15:
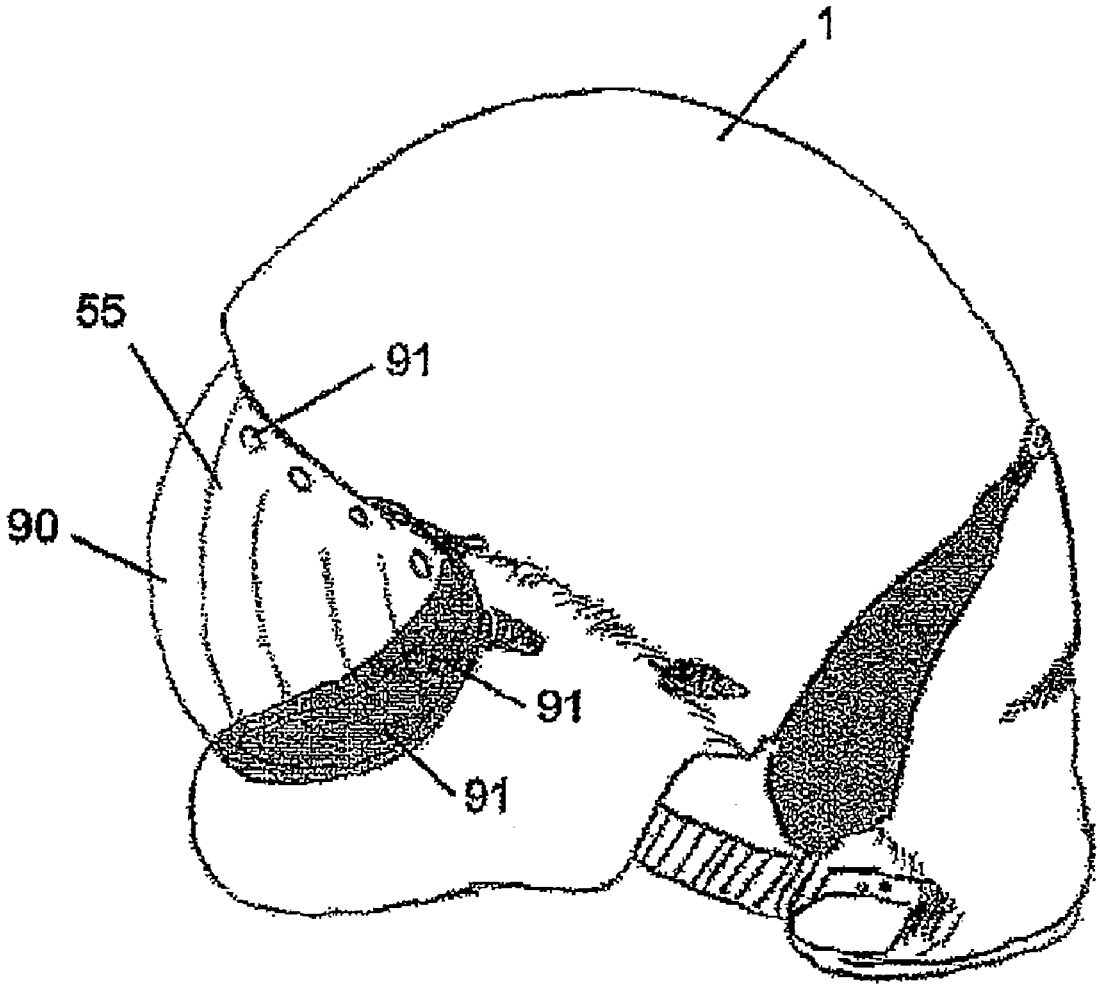
FIG. 15 is a side view of a helmet an alternate embodiment.

Referring again to FIGS. 1 to 8, beading similar to that along edge 51 is found at other locations on helmet 1; for example around head receiving opening 55 and vision enabling opening 56. Opening 56 extends approximately 240 degrees about a central axis of the helmet to provide a relatively high level of peripheral vision. Referring to FIG. 15, a transparent cover 90 is in some cases applied across opening 55. FIG. 14 illustrates a bubble cover 90 having a plurality of ventilation holes 91. In this case the cover substantially seals opening 56. However, in other cases a half cover is used, this cover extending across an upper portion of opening 55. It will be appreciated that such a half cover protects a user's eyes and allows for increased ventilation. Further, the risk of vision affecting condensation is reduced.

Figure 16:
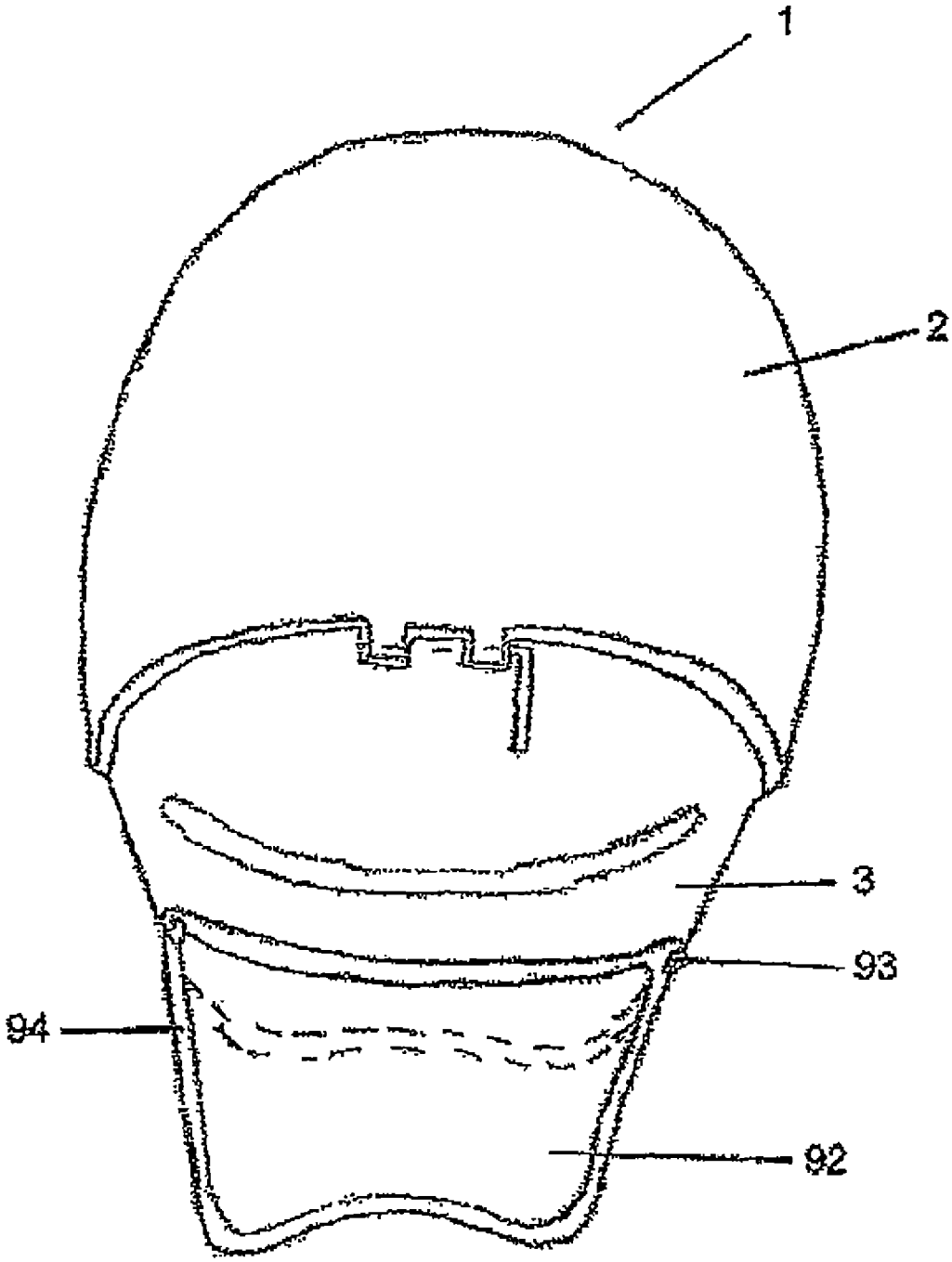
FIG. 16 is a rear view of a helmet a further alternate embodiment.

Opening 55 is partially defined by a lower support edge 58 of shell 3. This edge is approximately spatially configured for engagement with a muscular region of a back defined on the body providing head 4. Further, the illustrated edge 58 approximately conforms to a complimentary edge of a known protective vest where such a vest is conjunctively used. In some embodiments an additional protector 92 is attached to helmet 1 top provide additional protection to a user's neck and back. For example, a rigid protective flap is hingedly connected to shell 3 by rivets 93, as shown in FIG. 16. This protector 92 includes a beaded edge 94 similar to edge 58. In other embodiments alternate protectors are used, including fixedly mounted flaps, protectors that provide a cylinder about the neck, and integrated upper-body protective suits.

Figure 11:
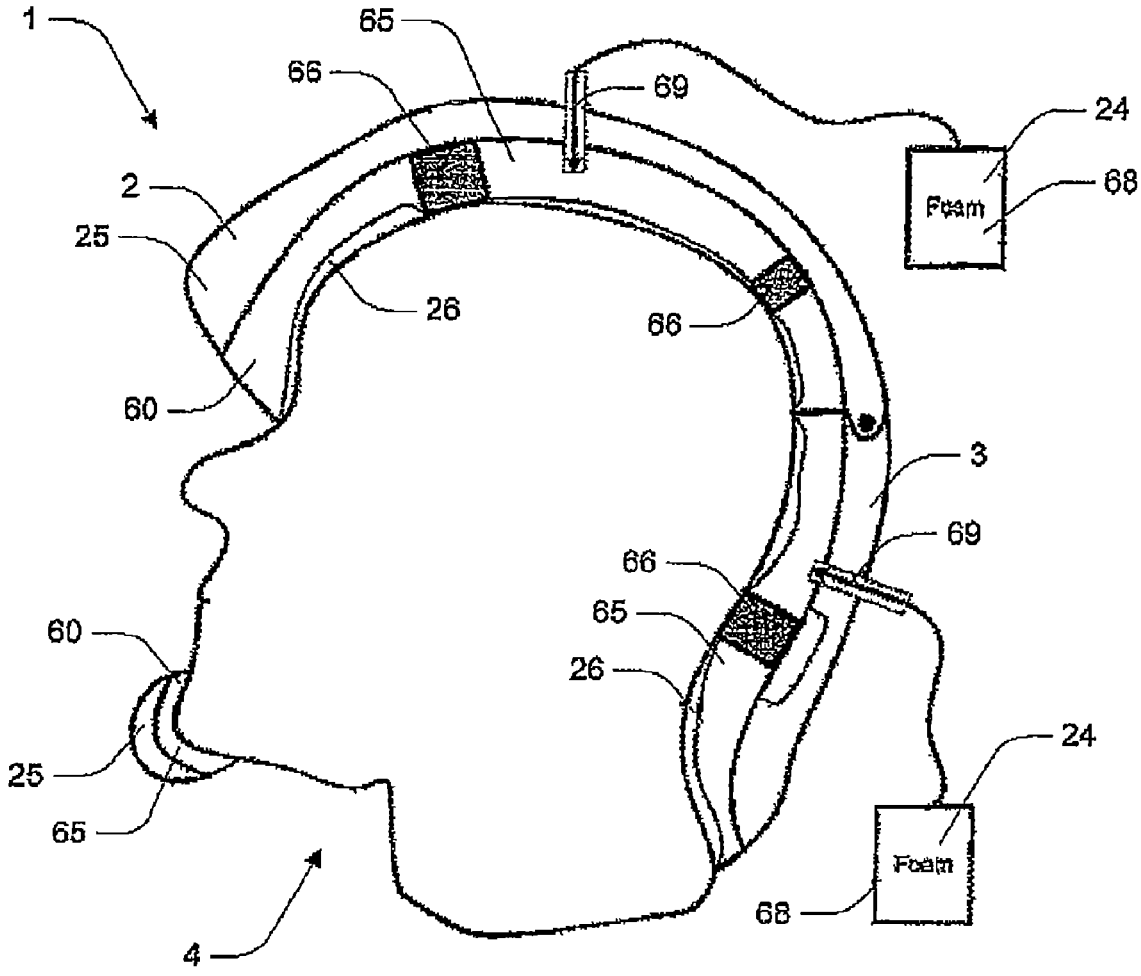
FIG. 11 is a view similar to FIG. 6, schematically illustrating foam injection.

FIG. 11 illustrates in greater detail the layered construction of helmet 1. There are two major layers: casing layer 25 and an inner lining layer 60. Lining layer 60 includes foam 24 and inner lining 26, although FIG. 11 shows helmet 1 prior to foam injection. It will be appreciated that, in such a state, lining 26 does not conform smoothly to head 4.

Casing 25 provides impact resistance and deflection properties, and lining layer 60 provides padding and the three-point fit.

In the present embodiment, inner lining 26 is spaced apart from the inner surface of casing 25 to define a cavity 65 for receiving foam 24 during foam injection. In some embodiments an additional layer (not shown) is provided intermediate cavity 65 and casing 25, this layer being glued to casing 25. In further embodiments this additional layer includes a pre-moulded foam layer to reduce the amount of foam 24 required during the injection process; for example a 15 mm layer.

Several resilient foam spacers 66 are provided in cavity 65 such that helmet 1 is comfortably and accurately positionable on head 1 prior to foam injection. This positioning will be understood by those skilled in the art; and typically helmet 1 is provided with an instruction manual to help assist a user realise this positioning in practice. The rationale is that a user performs foam injection following purchase of helmet 1.

The width of cavity 65 varies between embodiments. Typically an average width of between 25 and 35 millimeters is suitable for general equestrian protection. The width determines the amount of padding provided, although the size of head 4 also plays a role. That is, for a given helmet 4, more padding is provided for a smaller head, whilst less padding is provided for a larger head. In some cases different sizes of casing 25 are manufactured to suit a wide range of head sizes such that a threshold level of padding is provided in most if not all cases.

To foam inject liner 60, helmet 1 is first placed on head 4 and locked in the closed configuration. At this time there is some ability to move helmet 1 on head 4 given that effective three-point fitting is not yet provided. Spacers 66 loosely hold helmet 1 in a desired position. Quick hardening liquid foam 24 is provided in a can 68. Once helmet 1 is positioned in an appropriate comfortable alignment on head 4, foam 24 is injected into apertures 69 provided on shell 2 and shell 3. Typically there are two apertures on shell 2 and a single aperture on shell 3. It will be appreciated that cavity 60 includes a first portion on shell 2 and a distinct second portion on shell 3 given that the shells are distinct The foam is continuously injected until cavity 65 is filled. This event is marked by either a predetermined quantity of foam being injected or by a noticeable overflow. The foam will then harden and expand, excess foam being expelled through apertures 69. The hardening foam expands to press and retains lining 26 against adjacent regions of head 4 to provide a customised and relatively exact fit, and provide the three point fitting system. After a predetermined curing period, typically about five minutes, the foam is sufficiently hard such that helmet 1 is removable from head 4. This excess foam is easily removed, and the apertures plugged. Those skilled in the art will recognise benefits associated with customised foam injection fitting.

As mentioned, a consumer typically carries out this foam-injection process following purchase of helmet 1. In other embodiments alternate linings 60 are provided which do not require foam-injection, and these typically include a foam layer in lining layer 60 at the time of purchase. That is, these helmets are ready for use off the shelf. Although the fit is inherently less ideal as compared with foam injection, the cost savings are typically substantial.

Figure 26:
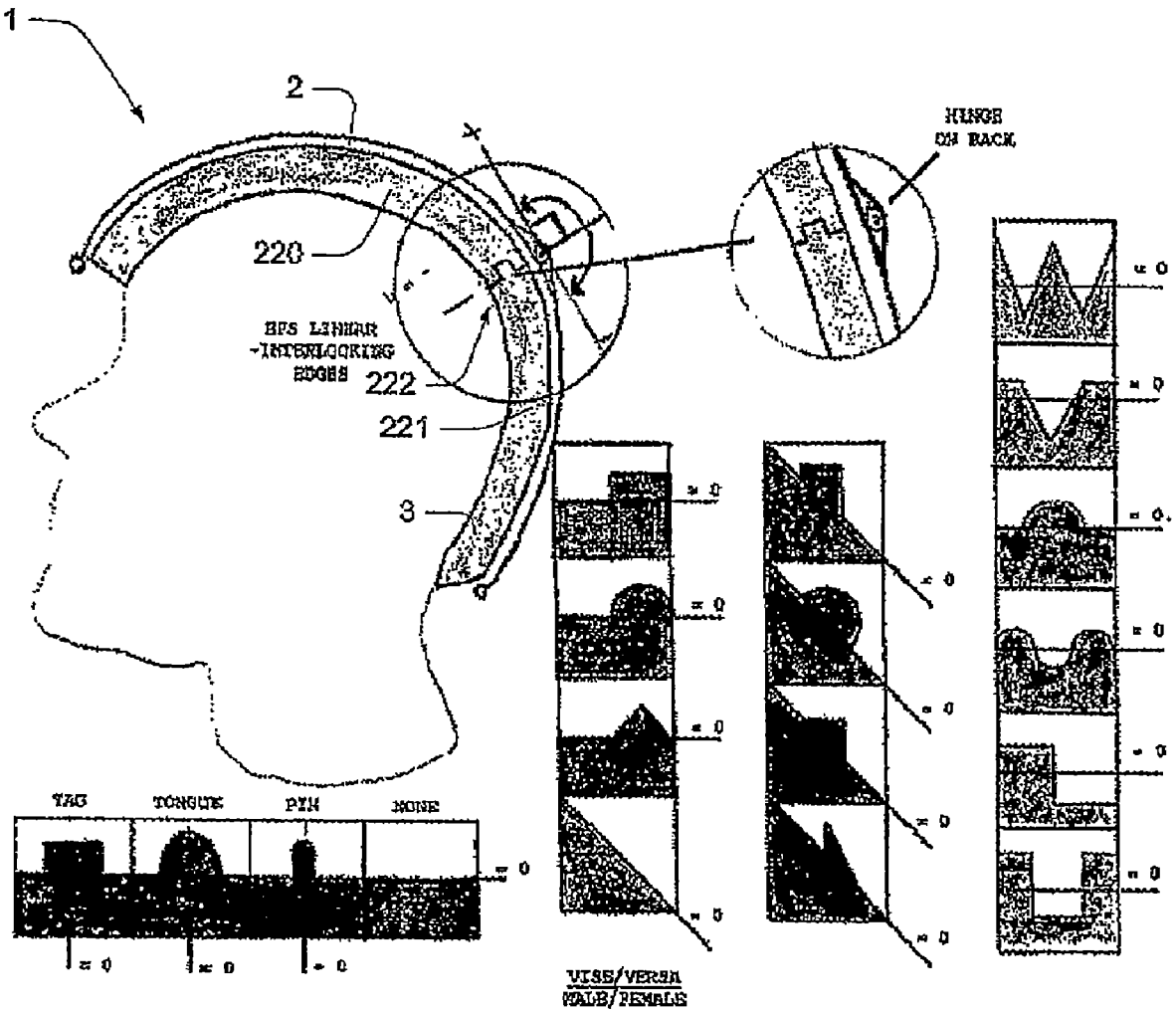
FIG. 26 illustrates a locking technique and various alternative configurations thereof.

FIG. 26 illustrates an embodiment where shells 2 and 3 each include respective EPS liner portions 220 and 221. Upon closing the helmet, these liner portions meet at an engagement region 222. In some embodiments liner portions 220 and 221 include respective fitting formations, typically male/female fitting formations, to provide an improved locking fit between the liner portions when the helmet is in the closed configuration. FIG. 26 illustrates a variety of male/female fitting formations that are used in some embodiments of the present invention.

In the present embodiment, casing 25 is formed of a Kevlar/graphite weave. These materials are particularly well suited given their high levels of strength and relatively low weights. The manufacturing process involves the making of a split mould for shell 2 and a separate mould for shell 3. In, some embodiments where a separate inner shell is used to define-tunnel 49 that inner shell requires its own mould.

The moulds are each cleaned and jelled with a release agent in preparation for a layering process of woven Kevlar and graphite layers. Three layers are laid into the shell 2 section of the split mould and resin is applied upon placement of each layer to best ensure that no air bubbles form between the woven layers. The same is done in relation to the other section or sections.

In edges of the helmet are typically double layered, which equates to a six-layer edge, which in turn giver superior strength to all edges of the helmet. The layering process is critical to the strength of the helmet, and special attention is paid to all moulded edges to ensure optimum strength. Doubling the layers from three to six layers on the edge best ensures strength in all directions of compression.

In one embodiment, about six hours the resin has cured sufficiently to enable shell 2 and 3 sections of casing 25 to be released from their respective moulds. In other embodiments this time period varies, often relative of the resin used. The moulds are then cleaned and release agent applied for subsequent use.

The shell-based components of hinge assembly 28 are moulded into the edges of both shell 2 and shell 3 regions of casing 25 during the initial layering process to facilitate both hinge strength and concealment.

Once casing 25 is formed, mechanisms 29 are attached by way of washers and alloy pop rivets. It is typically preferable to test these mechanisms prior to installing lining layer 60.

Typically, appropriate split moulds are formed of fibreglass and resin, however a number of different types of materials can be used to make these moulds depending on manufacturing objectives such as throughput, cost and quality. Some mould materials will produce more shells than others due to reduced wear.

Manufacturing of casing 25 by such methods is relatively expensive and time consuming. However, the overall strength, weight, and quality of the helmet 1 produced are of superior levels. In some embodiments alternate moulding techniques are used to save costs and time. Injection moulding is a prime example. Other materials particularly well suited to the construction of casing 25 include polycarbonates and bulletproof resins. It will be appreciated that the latter is most suitable for military applications.

Once manufacture of a casing 25 is completed, and assuming foam injection is to be used, the next step is to glue and mould inner lining 26 to casing 25 such that cavity 65 is defined. A dummy head is used to position lining 26, and 25 mm spacers 66 are applied at about five points on the inner surface of casing 25 to preserve cavity 65 and assist fitting. The helmet is typically then packaged with fitting instructions, foam injection tools such as foam canisters and tubing, and prepared for sale.

In embodiments where foam injection is not used, it is typically necessary to manufacture a variety of linings 60 to accommodate various head sizes. These linings are typically formed inclusive of a preselected amount of resilient foam 24 or rubber prior to insertion and adhesion in casing 25. Such processes are known in the art, and will be understood by skilled addressees.

Figure 17:
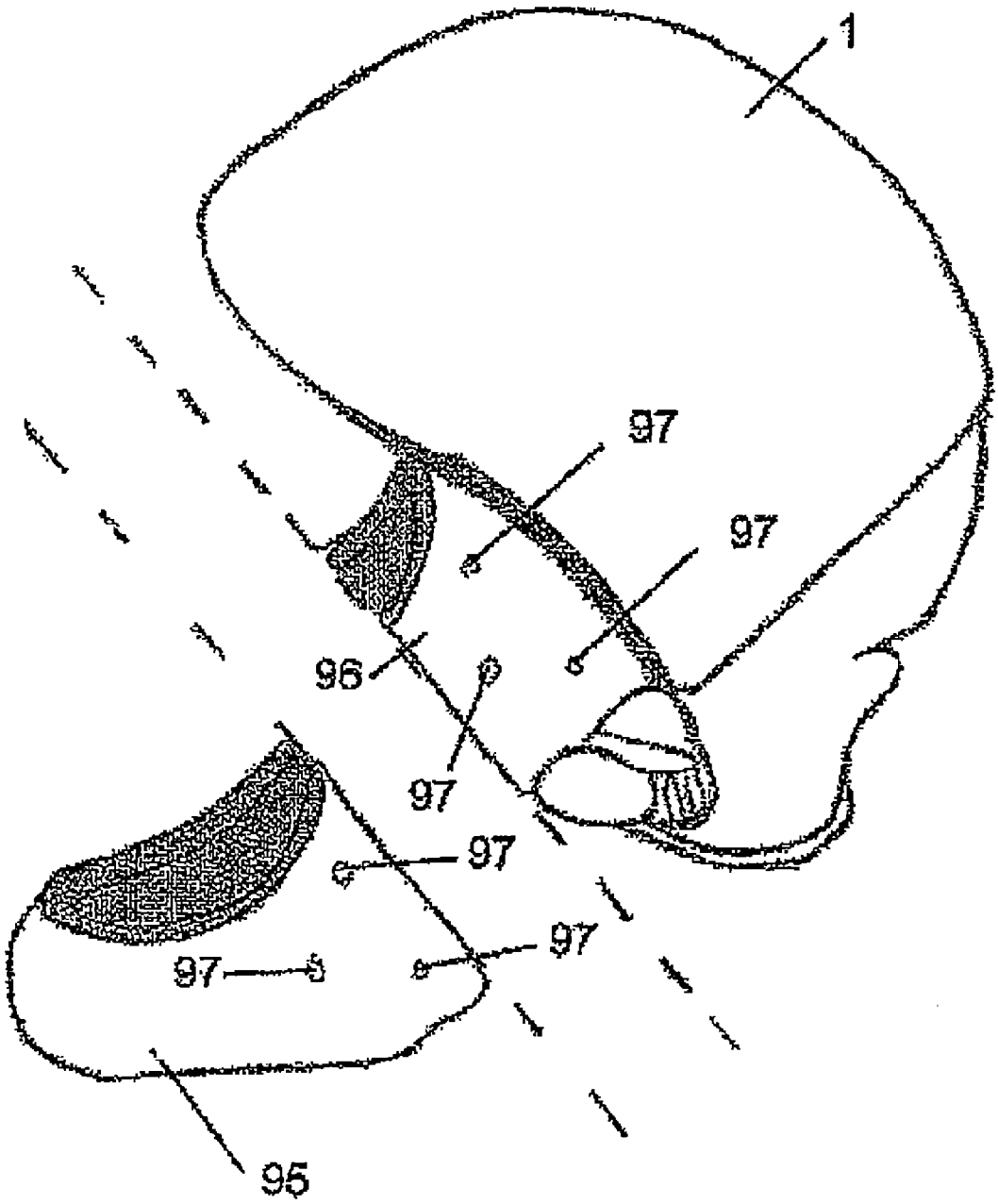
FIG. 17 is a side view of a helmet a still further alternate embodiment.

FIG. 17 illustrates an embodiment where shell 2 includes a detachable chin protector 95. It will be appreciated that this allows for alternate sizes of protectors 95 to be manufactured to allow for a more precise fit in cases where foam injection is not used. For example, a larger protector 95 is provided to a person having a longer jaw structure. Protector 95 is, in use, attached to a receiving portion 96 of shell 2. In the illustrated embodiment this is by way of three rivets on each side, which extend through apertures 97. In other embodiments alternate connection techniques are used, such as strong glues.

In some embodiments, a visor assembly 70 is mountable to helmet 1, typically on shell 2. For equestrian applications, this visor is mounted such that impact from a hoof causes substantially instant detachment. This reduces the effect of visor 70 on deflection properties. The visor is typically substantially formed from similar materials to casing 25.

Figure 12:
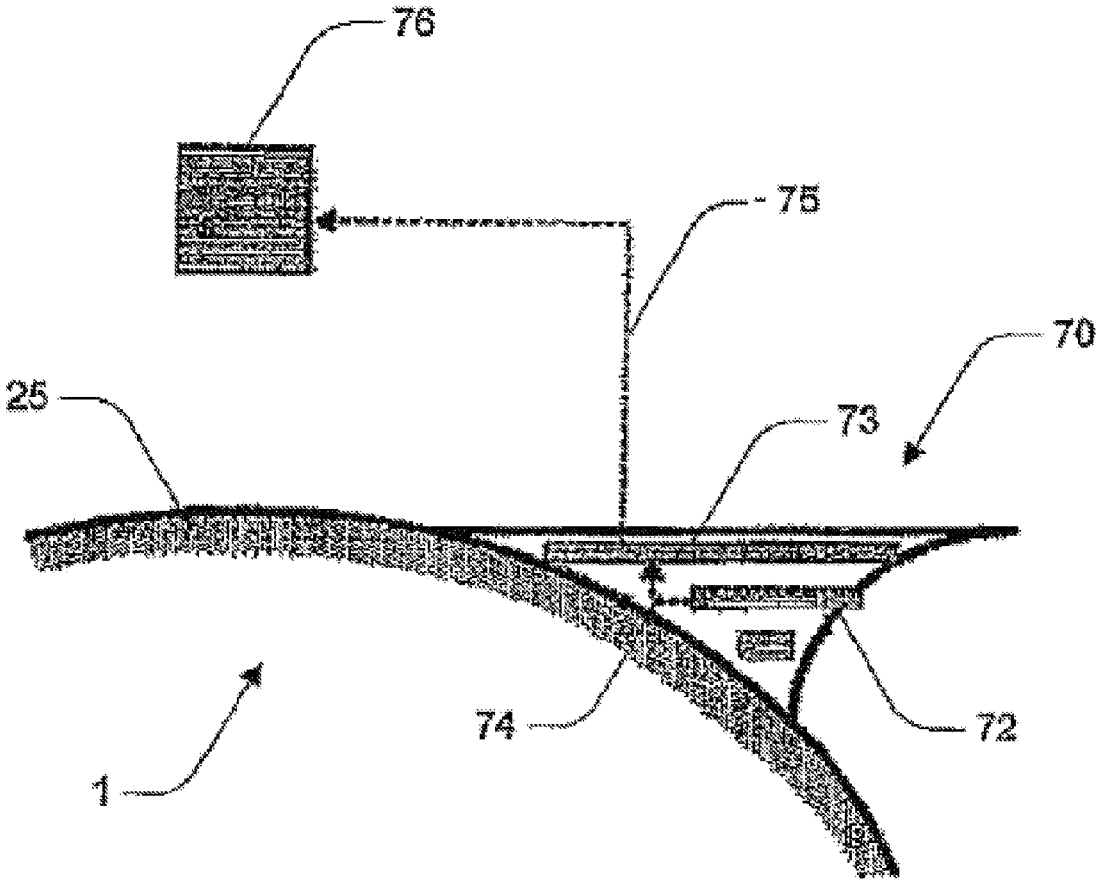
FIG. 12 is a schematic sectional view of a visor for attachment to the helmet of FIG. 1.

In the embodiment of FIG. 12, visor 70 includes a small video camera 72. This video camera is connected to a transmitter 73, and both of these are connected to a power supply. Camera 70 provides to transmitter 73 a signal 74 indicative of sequential captured frames defining video footage. In turn, transmitter 73 wirelessly provides a signal 75 to a remote host 76.

Visor 70 is preferably used for the purpose of providing "jockey-cam" footage of horseracing events. The visor 70 is attached to a helmet 1 of jockey 72.

In such an implementation, weight minimisation is a primary concern. As such, a relatively lightweight transmitter 73—preferably less than 300 grams—is selected. This typically equates to a short transmission range.

Figure 13:
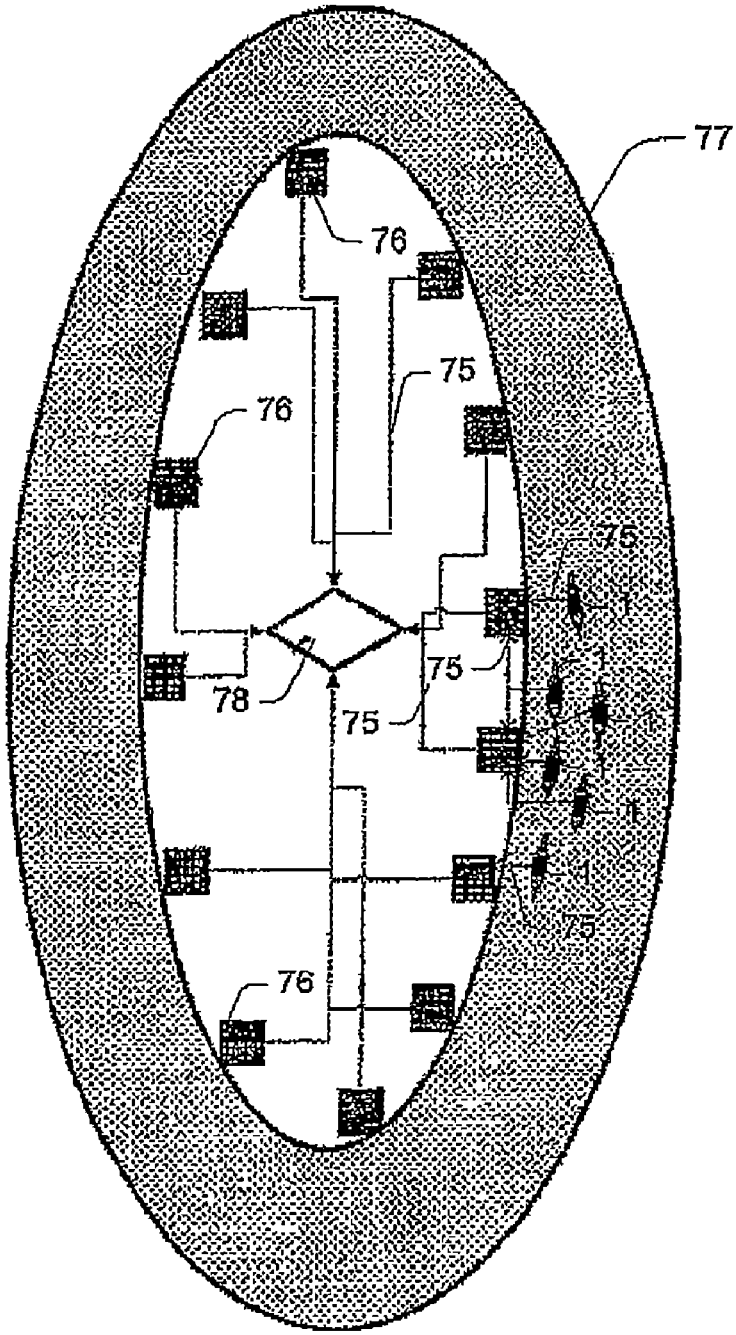
FIG. 13 is a schematic representation of a racetrack.

In the embodiment of FIG. 13, a plurality of spaced hosts 76 are provided around the periphery of a racetrack 77 to account for the short transmission range of transmitters 73. Each of these hosts receives signals 75 when transmitter 73 is within sufficient proximity for signal transmission. These hosts provide their received signal portions to a central controller 78 which is responsive to the signal portions for providing a continuous video feed on the basis of footage captured by camera. This will be recognised as an efficient and lightweight system for providing jockey-cam footage. Typically several visors 70 are shared among jockeys in a given race. While the illustrated embodiments shows cameras on all horses, an optimum number of cameras is typically about four per race. A network programmer switches from horse to horse depending on running positions and real-time events. Advantageously, in situations where each jockey in a race inherently owns and plans to wear a helmet 1, visor 70 facilitates the selection and convenient jockey-cam enabling of a subject jockey 72.

It will be appreciated that footage obtained through visor 70 is used for alternate purposes, such as assessing protest results.

In another embodiment, a small GPS disc or alternate locating device is mounted in helmet 1 or visor 70. Where the GPS disc is mounted to helmet 1, it is preferably removable. A rechargeable battery is provided to provide power to the GPS disc.

The disc provides a signal that is provided via satellite to a software system, which in turn records the helmet's movement. In one implementation, this is used to provide a protest resolution system for a race. Each jockey in the race wears a helmet 1 having a GPS disc, and movements of the jockeys (and their respective horses) throughout the race is converted into a visual digital representation. For example, a racetrack 80 is mapped and then placed on a scaled grid system 81, as shown in FIG. 14. The paths 82 of the jockey's are superimposed on this grid. In some cases predetermined interference rules are also programmed into the software such that interference protests are objectively resolvable.

For example, a protest is lodged between jockeys A, B, and C. The system prepares a representation of the paths of these jockeys and their respective horses on the basis of GPS positioning information. The paths for jockeys A, B and C axe marked on FIG. 14 by reference numerals 86, 87 and 88 respectively. The system identifies the points of interference during the running of the race with an (x) on the scaled racetrack and the information regarding the type of interference is displayed on the screen beside the points of interference.

It will be appreciated that having a complete image of the exact course of all of jockeys A, B and C during the race reduces the effect of human error whilst assessing protest results.

GPS technology is also used for further purposes, such as assessment of the motion of a jockey in a fall or horse velocity and or acceleration calculations.

Variations on helmet 1 are used for alternate applications or to provide further advantages. For example, in some embodiments ventilation holes are provided. In some cases a ventilation hole is positioned proximal the ear to improve hearing whilst wearing the helmet. In some cases the ventilation holes assist the foam injection process, although it is typically preferable to place a protective membrane on the inside of the holes during the injection process. The rationale is to substantially prevent foam from contacting directly with head 4.

Figure 23:
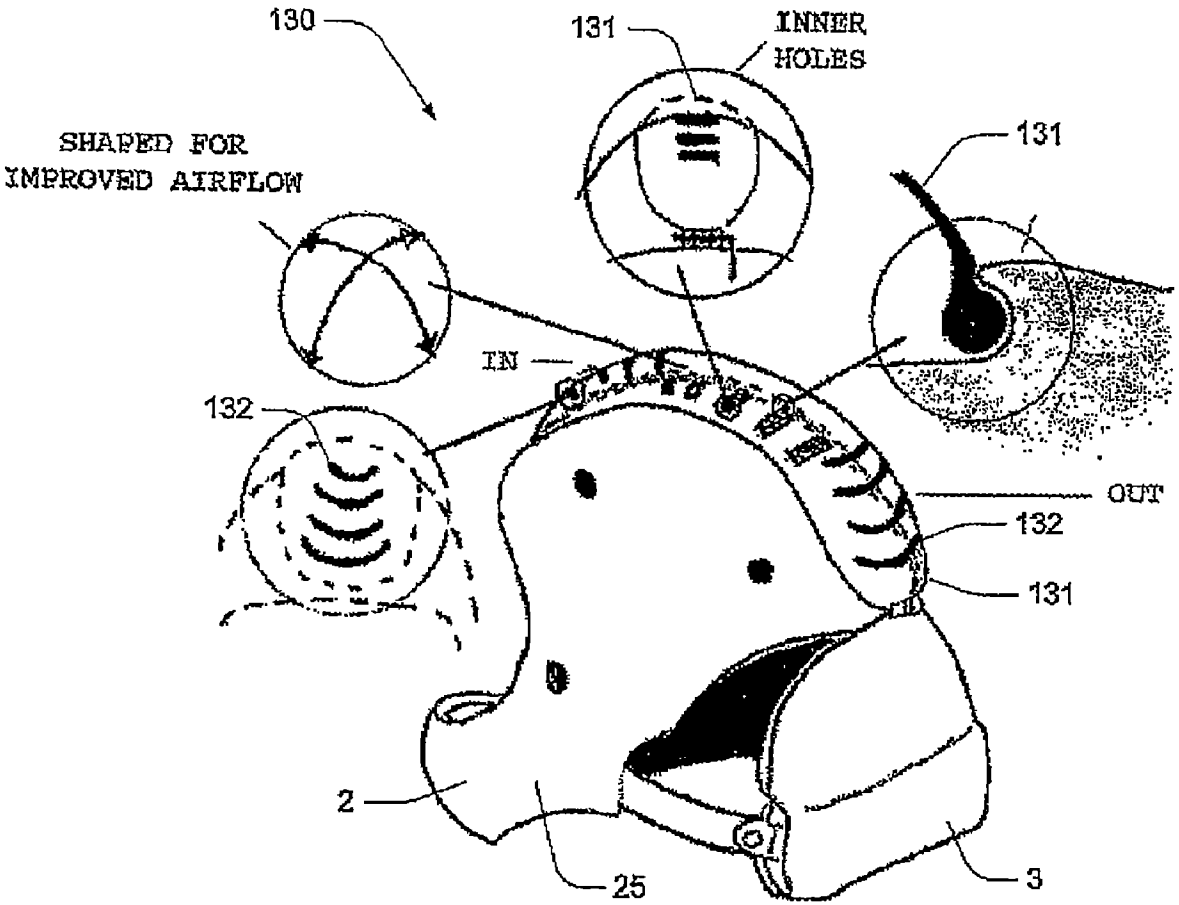
FIG. 23 is a perspective view of the embodiment of FIG. 21 showing some features in greater detail.

FIGS. 21 to 23 illustrate an alternate embodiment, in the form of a helmet 130. Helmet 130 is generally similar to helmet 1, however makes use of some differing design aspects, most noticeably the absence of a bulbous upper option, and the inclusion of a ventilation cover 131.

Ventilation cover 131 is a removable rigid component that is lockingly engageable with casing 25. Ventilation cover 131 is typically formed of a rigid material such as Kevlar or fibreglass, although plastics, may be used as an alternative. In this embodiment casing 25 includes a recessed central portion that, upon locking engagement of cover 131, provides an internal compartment that may optionally be used to store cameras, GPS modules, and the like. In the present embodiment casing 25 includes a plurality of ventilation holes that allow airflow communication between this internal compartment and the interior of the helmet.

In the present embodiment the central recessed portion in casing 25 includes a peripheral fitment for receiving a correspondingly profiled edge of cover 131. As such upon engagement of cover 131 with casing 25, cover 131 effectively includes a countersunk lockingedge. In some embodiments this edge continues about the entire periphery of cover 131, however in other embodiments it has broken portions to facilitate convenient connection/removal of the cover. In other embodiments alternate locking techniques are used for facilitating connection of the cover to the helmet casing.

Cover 131 provides a dual crash zone to helmet 131. The general notion is that, in the event of a harsh impact by an object to cover 131, the cover will in all likelihood break and fail prior to the object impacting on casing 25. This is thought to significantly reduce the risk of injury to a wearer due to the degree to which impact forces would be distributed and absorbed by the operation of casing 131.

Figure 35:
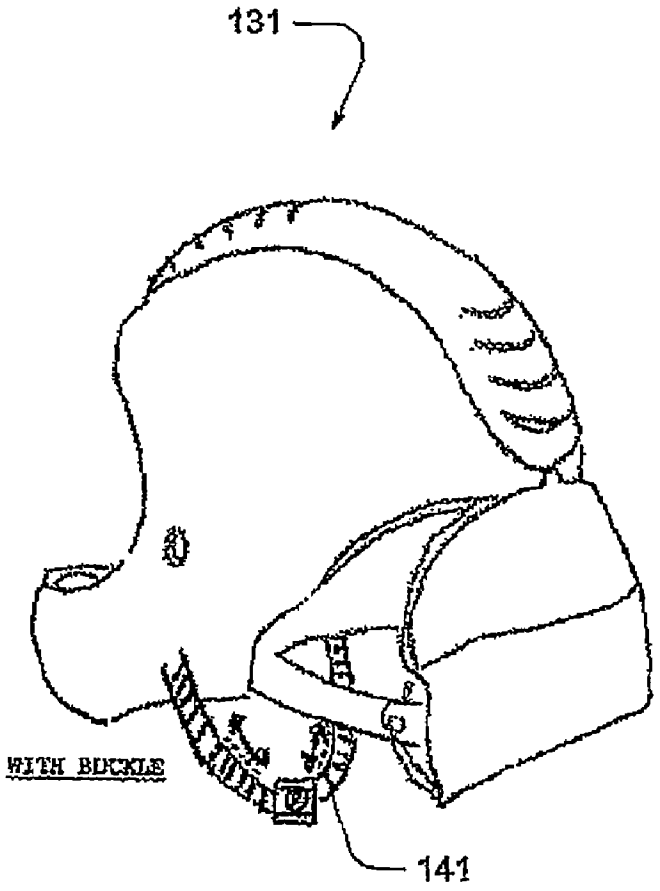
FIG. 35 illustrates a helmet including an adjustable chinstrap.

FIGS. 34 and 35 illustrate helmet 131 in combination with relatively conventional chinstraps. It will be appreciated from the teachings above that a chinstrap is not required for effective retention of such a helmet on a wearer's head given the three zone fitting system that is used. In particular, the helmet is not removable from a wearer's head when in the closed configuration. However, in some instances it is preferable to include a conventional chinstrap for any of the following reasons:

- To improve wearer confidence, given popular familiarity with conventional chinstraps.
- To provide a more secure fit, particularity in cases where a chin cup is not ideally positioned on a wearer's chin.
- To reduce the risk of the helmet becoming dislodged upon failure of the dorsal hinge assembly 28. For example: following a harsh and direct impact to the hinge assembly.

The embodiments of FIGS. 34 and 35 respectively illustrate chinstraps 140 and 141 without and with fitting buckles. In overview, fitting buckles are commonly used with conventional chinstraps. However, in a rear entry helmet such as that illustrated, it is typically not necessary to loosen or disconnect a chinstrap to allow the insertion of a head.

Figure 36:
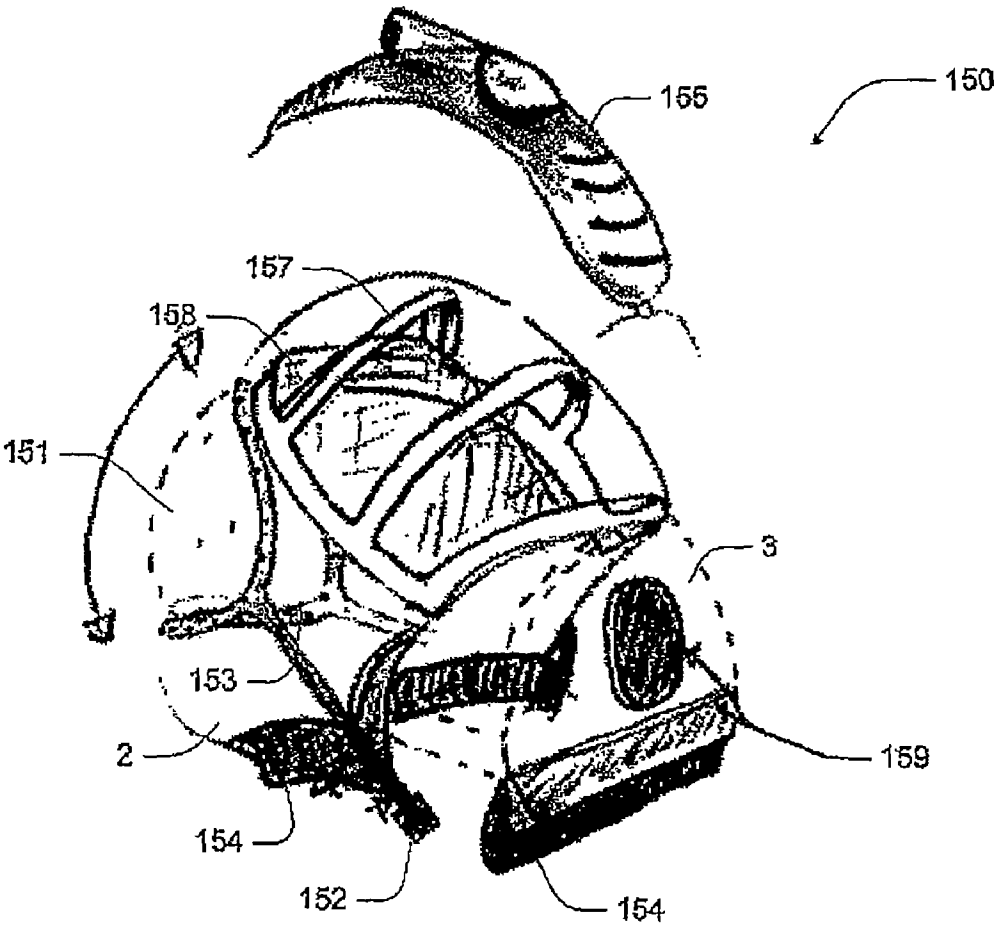
FIG. 36 illustrates a helmet according to a further embodiment.

FIG. 36 illustrates a similar embodiment in the form of a helmet 150. Helmet 150 is particularly suitable for persons working in hazardous environments, such as fire fighters. Helmet 150 includes a visor 151, and one or more air jacks 152 for distributing air from an external source to the interior of the helmet via apertures 153. This creates a positive air pressure inside the helmet such that external air is substantially prevented from entering. Furthermore, in this embodiment apertures through which air can escape are provided at and around the visor. This not only assists in creating a cooling circulation throughout the helmet and providing fresh air to the wearer, but also assists in reducing the chances of the visor fogging due to moisture. A two-part sheath 154 is provided for substantially sealing the helmet around a wearer's neck. This sheath is, for fire-fighting applications at least, formed of a heat and fire resistant material. However other resilient materials such as rubber or neoprene may also be used.

An optional visor assembly 155 is attachable to helmet 150, this assembly carrying a camera, GPS unit, and one or more power supplies for powering these and other components. For example, in one embodiment an electronic eye display is projected onto the visor.

Another special feature of helmet 150 is a suspended fitting system. In this embodiment a three point fit is provided by a chin cup as described above, localised regions of EPS 159 on shell 3, and a suspended mesh fitting formation 157 in shell 2. Fitting formation 157 includes a mesh 158 for engagement with the top and front of the wearer's head, and this is typically adjustable to provide a customised fit for a variety of head sizes. Similar suspended fitting formations are common in helmets made for the construction industry, and provide a cavity intermediate the formation and helmet shell such that impacts may be dealt with by resilience in the fitting formation as opposed to a resilient liner in the shell. To this end, the formations are typically formed materials such as Kevlar or nylon. An added benefit is improved airflow within the helmet due to empty space above the head. The spacing between the wearer's head and the helmet shell is typically maintained at between 25 mm and 100 mm, more usually between 25 mm and 50 mm.

Other applications for which variations of helmet 1 and other helmets described herein are suited include rock climbing, snow sports, water sports, cycling, skateboarding, martial arts and similar body contact sports, skydiving, motor racing, recreational motor bike usage, military purposes, and so on. Those skilled in the art will recognise various modifications made to helmet 1 that increase suitability for these and other applications.

It should be appreciated that in the above description of exemplary embodiments of the invention, various features of the invention are sometimes grouped together in a single embodiment, Figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention; and form different embodiments, as would be understood by those in the art. For example, in the following claims, any of the claimed embodiments can be used in any combination.

Thus, while there has been described what are believed to be the preferred embodiments of the invention, those skilled in the art will recognize that other and further modifications may be made thereto without departing from the spirit of the invention, and it is intended to claim all such changes and modifications as falling within the scope of the invention. That is, although the invention has been described with reference to a specific example, it will be appreciated by those skilled in the art that the invention may be embodied in many other forms.

The claims defining the invention are as follows:

1. A protective helmet comprising:

a front shell; and a rear shell which is pivoted with respect to the front shell to provide:

an open configuration for receiving within the helmet or removing from the helmet a head;

a closed configuration wherein the rear shell is releasably lockingly engaged to the front shell for securely containing the head within the helmet such that, when the helmet is in the closed configuration, a portion of the front shell wraps under the chin of the head such that the head is not able to be removed from the helmet;

wherein the front shell includes a first fitting zone for engagement with the forehead region of the head;

wherein the helmet includes a second fitting zone for engagement with a chin region of the head, wherein the second fitting zone is provided on an adjustable chin cup that is separate from the portion of the front shell that wraps under the chin and that is mounted via one or more fasteners to the front shell, for cupping and securing the chin region, and wherein there is a spacing intermediate the outer side of the chin cup and the portion of the front shell that wraps under the chin thereby to allow limited resiliently opposed movement of the jaw upon frontal impact when the helmet is in the closed configuration; and wherein the rear shell includes a third fitting zone for engagement with a posterior region of the head when the helmet is in the closed configuration thereby to provide a three zone fitting system for securely containing the head within the helmet.

2. A protective helmet according to claim 1, wherein the front shell comprises a first edge complimentarily engageable with a second edge on the rear shell, the first and second edges comprising respective complimentary inter-engaging locating formations extending substantially along the length of the edges, these locating formations being mutually locatingly engaged when the helmet is in the closed configuration to substantially transversely locate the front shell with respect to the rear shell, wherein the locating formations are defined by the cross-sectional profiles of the first and second edges, wherein one of the edges comprises a beaded peripheral lip to define one of the complimentary locating formations and the other edge comprises a recessed peripheral channel for receiving the lip to define the other complimentary locating formation, the channel being defined by a pair of opposed sidewalls, wherein upon these locating formations being mutually locatingly engaged, the lip is contained between the opposed sidewalls of the channel.

3. A helmet according to claim 2, wherein both edges include a beaded peripheral lip and a recessed peripheral channel, each edge being configured such that its channel receives the other edge's lip when the helmet is in the closed position.

4. A helmet according to either claim 2 or claim 3 wherein each lip has either a round, rectangular, or triangular shape, and the corresponding channel is likewise shaped to receive the lip.

5. A helmet according to claim 2, wherein the lip comprises a plurality of engagement teeth, and wherein the channel comprises a plurality of corresponding formations for receiving the engagement teeth when the helmet is in the closed position.

6. A helmet according to claim 2, wherein the edge comprising the beaded peripheral lip further includes a locating protrusion that protrudes from the lip, and wherein the edge comprising the recessed peripheral channel includes a complementary fitment for receiving the locating protrusion when the helmet is in the closed position.

7. A helmet according to claim 1 wherein the front and rear shells are lockingly engagable by a multiple point locking system.

8. A helmet according to claim 7 wherein the multiple point locking system comprises an upper dorsal connection and two lower side connections.

9. A helmet according to claim 8 wherein the upper dorsal connection includes a hinge such that the rear shell is hingedly connected to the front shell for rotation between the closed configuration and the open configuration.

10. A helmet according to claim 9 wherein each side connection comprises an adjustable connector mechanism for designating a selectable proximity between adjacent connector regions of the front and rear shells.

11. A helmet according to claim 10 wherein the mechanism comprises an elongate member selectively releasably lockingly engageable with a complimentary fitment.

12. A helmet according to claim 11 wherein the front shell comprises the member and the rear shell includes the fitment.

13. A helmet according to claim 11 wherein the front of the member extends progressively through the fitment upon the engagement to define a tail portion, and a tunnel is provided in the rear shell for receiving and concealing the tail portion.

14. A helmet according to claim 11 wherein the member is rotatable with respect to the front shell such that it remains within the fitment upon hinged rotation of the shells.

15. A helmet according to claim 11 wherein the fitments are moveable from a locked configuration in which the allowed passage of the member is unidirectional and an unlocked configuration in which the allowed passage of the member is bi-directional.

16. A helmet according to claim 15 wherein both fitments must be in the unlocked configuration for the helmet to move from the closed to open configuration.

* * * * *